US009454124B2

(12) United States Patent
Takasaka et al.

(10) Patent No.: US 9,454,124 B2
(45) Date of Patent: Sep. 27, 2016

(54) IMAGE FORMING APPARATUS

(71) Applicant: CANON KABUSHIKI KAISHA, Tokyo (JP)

(72) Inventors: Atsushi Takasaka, Mishima (JP); Noriyuki Komatsu, Numazu (JP); Osamu Anan, Susono (JP); Tetsuya Numata, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/709,121

(22) Filed: May 11, 2015

(65) Prior Publication Data

US 2015/0331382 A1 Nov. 19, 2015

(30) Foreign Application Priority Data

May 15, 2014 (JP) ..... 2014-101224
Mar. 11, 2015 (JP) ..... 2015-048176

(51) Int. Cl.

| | |
|---|---|
| ***G03G 21/18*** | (2006.01) |
| ***G03G 15/16*** | (2006.01) |
| ***G03G 21/00*** | (2006.01) |
| ***G03G 15/04*** | (2006.01) |
| ***G03G 21/16*** | (2006.01) |

(52) U.S. Cl.

CPC ..... *G03G 21/00* (2013.01); *G03G 15/04036* (2013.01); *G03G 21/1666* (2013.01); *G03G 2215/0132* (2013.01); *G03G 2221/1684* (2013.01)

(58) Field of Classification Search

CPC ..... G03G 21/00
See application file for complete search history.

(56) References Cited

U.S. PATENT DOCUMENTS 9,122,240 B2 * 9/2015 Hashimoto ..... G03G 21/1853
2008/0286001 A1 * 11/2008 Matsumoto ..... G03G 21/1825 399/112

FOREIGN PATENT DOCUMENTS

JP 3608767 B2 1/2005
JP 2013-228635 A 11/2013

* cited by examiner

*Primary Examiner* — David Gray
*Assistant Examiner* — Michael Harrison
(74) *Attorney, Agent, or Firm* — Canon U.S.A., Inc. IP Division

(57) ABSTRACT

An image forming apparatus includes an apparatus main body and a movable member configured to move with respect to the main body while supporting an image bearing member and a developer bearing member. The movable member is movable to a position located inside the main body, where the two bearing members is in an image formable state, and a position located outside the main body, where a cartridge including the developer bearing member is detachable from the movable member. The apparatus further includes an exposure device configured to expose the image bearing member via a light transmission member, and a cleaning member configured to clean a surface of the light transmission member opposed to the movable member. The cleaning member is provided on the movable member and is movable to a contact position for contacting the light transmission member and a noncontact position when the movable member moves.

20 Claims, 29 Drawing Sheets

IMAGE FORMING APPARATUS

BACKGROUND OF THE INVENTION

1. Field of the Invention

The present invention relates to an image forming apparatus, and more particularly to an image forming apparatus for forming an image on a recording medium using an electrophotographic process. The present invention is suitably applicable to a copying machine, a printer (e.g., a light-emitting diode (LED) printer, a laser beam printer), a facsimile machine, and a word processor.

2. Description of the Related Art

A process cartridge is known as a cartridge type used in a conventional image forming apparatus using the electrophotographic image forming process. In the process cartridge, a drum and a developing unit, which includes a developing roller that acts on the drum and stores a developer (toner) to be used for image formation, are integrated with each other. A developing cartridge is also known as the cartridge type, which is configured to be independent of the drum and include only the developing unit. These types of cartridges allow a user to perform maintenance work for the apparatus by himself/herself without relying on a service engineer. Thus, these cartridges have been widely employed in a variety of electrophotographic image forming apparatuses.

Further, there is known a technique in which an image forming apparatus is configured to include a movable member that places a process cartridge or a developing cartridge therein and allow a user to pull out the movable member from inside the main body of the image forming apparatus to a predetermined position outside the main body so that the user can perform various cartridge replacement works. According to this technique, the user can easily replace the developer, for example.

Furthermore, as discussed in Japanese Patent No. 3608767 or Japanese Patent Application Laid-Open No. 2013-228635, there is known a method in which the movable member is provided with a cleaning member for cleaning an exposure portion of an exposure device that is used in the electrophotographic image forming process, so that the exposure portion is cleaned by the cleaning member when the movable member moves. In the method discussed in Japanese Patent Application Laid-Open No. 2013-228635, the movable member includes a recessed portion for collecting dust particles removed by the cleaning member.

In the above-described conventional techniques, the following problems arise. When the movable member is repeatedly moved and the cleaning member repeatedly performs the cleaning operation to clean the exposure portion, the cleaning member may deteriorate, leading to a decrease in its cleaning capability. Further, in the configuration discussed in Japanese Patent Application Laid-Open No. 2013-228635, in which the dust particles removed by the cleaning member are collected in the recessed portion provided in the movable member, once the recessed portion has been filled with the collected particles, it becomes unfeasible to collect dust particles in the recessed portion even when the particles are removed by the cleaning member. In these cases, the cleaning capability of the cleaning member may decrease after the cleaning member has performed the cleaning operation for a certain period of time.

Accordingly, maintaining the cleaning capability of the cleaning member for a long time is required in the above-described conventional configurations.

SUMMARY OF THE INVENTION

According to an aspect of the present invention, an image forming apparatus includes an apparatus main body, a movable member configured to move with respect to the apparatus main body in a state where the movable member supports an image bearing member on which a latent image is to be formed and a developer bearing member that bears a developer for developing the latent image, wherein the movable member is movable to an image forming position, located inside the apparatus main body, at which the image bearing member and the developer bearing member are brought into an image formable state and an attachment/detachment position, located outside the apparatus main body, at which a cartridge including the developer bearing member is attachable/detachable to/from the movable member. The image forming apparatus further includes an exposure device configured to form the latent image by exposing the image bearing member via a light transmission member, and a cleaning member configured to clean a surface of the light transmission member opposed to the movable member according to a movement of the movable member. The cleaning member is provided on the movable member to move with respect to the movable member, so as to be movable to a contact position at which the cleaning member makes contact with the light transmission member when the movable member moves, and a noncontact position at which the cleaning member does not make contact with the light transmission member when the movable member moves.

Further features of the present invention will become apparent from the following description of exemplary embodiments with reference to the attached drawings.

DESCRIPTION OF THE EMBODIMENTS

Exemplary embodiments of the present invention will be described in detail below with reference to attached drawings.

<Image Forming Apparatus>

Figure 1:
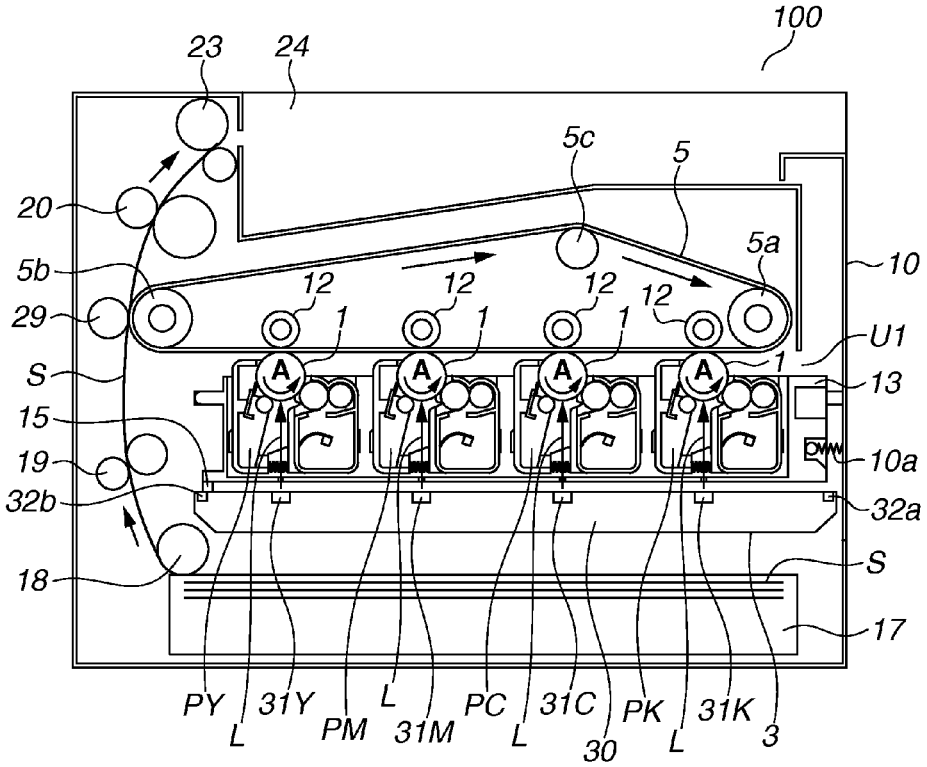
FIG. 1 is a cross-sectional view illustrating an image forming operation performed by an image forming apparatus according to a first exemplary embodiment of the present invention.
Figure 2:
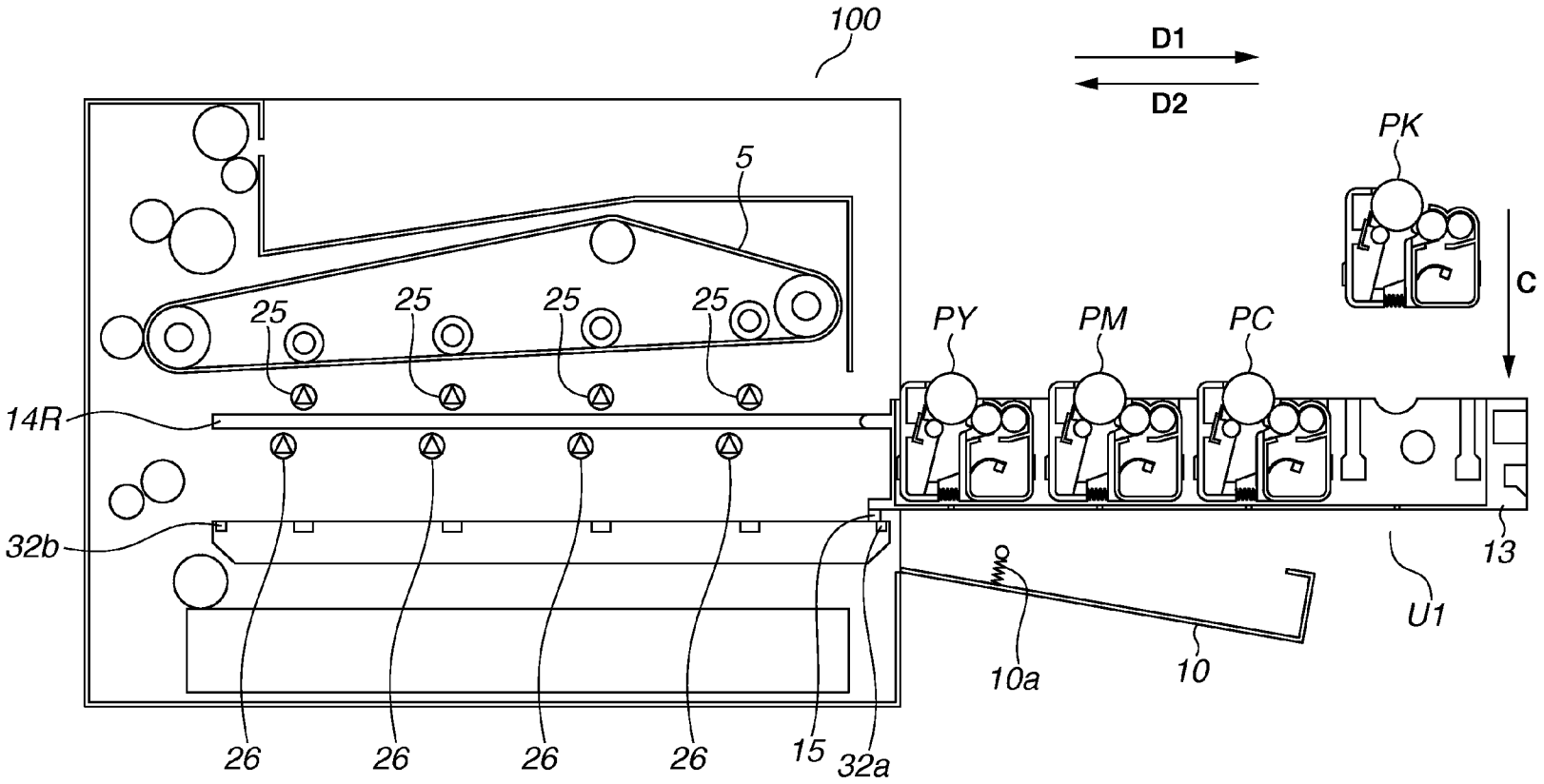
FIG. 2 is a cross-sectional view illustrating a state where a drawer unit according to the first exemplary embodiment has being pulled out from a main body of the image forming apparatus.
Figure 7:
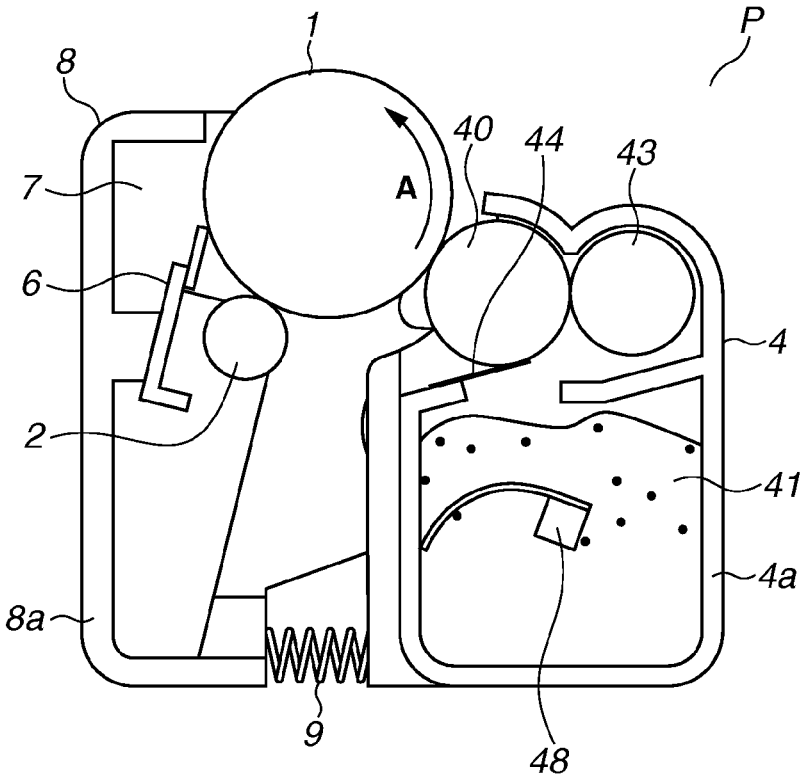
FIG. 7 is a cross-sectional view illustrating a cartridge according to the first exemplary embodiment.

The entire configuration of an image forming apparatus according to a first exemplary embodiment of the present invention will be described with reference to FIGS. 1, 2, and 7. FIG. 1 is a cross-sectional view illustrating an image forming apparatus 100 according to the first exemplary embodiment in a state where the image forming apparatus 100 performs an image forming operation. FIG. 2 is a cross-sectional view illustrating a drawer unit UI according to the first exemplary embodiment in a state where the drawer unit UI has been pulled out from the main body of the image forming apparatus. FIG. 7 is a cross-sectional view illustrating a cartridge P according to the first exemplary embodiment.

The image forming apparatus 100 according to the present exemplary embodiment includes four electrophotographic photosensitive members (hereinafter, referred to as "drums 1") that are aligned in the horizontal direction. Each of the drums 1 is configured to rotate in a counterclockwise direction (indicated by an arrow "A") in FIG. 1 when the drum 1 is driven by a driving unit (not illustrated). Further, the image forming apparatus 100 includes a charging unit 2, an exposure unit (exposure device) 3, a developing unit 4, and an electrostatic transfer unit 5, each of which serves as an electrophotographic image forming process unit, in addition to the drum 1 (i.e., an image bearing member).

The charging unit 2 has the capability of uniformly charging a surface of the drum 1. The exposure unit 3 includes an optical box 30, in which a light source and an optical system are provided, and a dust-proof member (31Y, 31M, 31C, and 31K) that serves as a light transmission member. The optical box 30 has an opening through which a laser beam L emitted from the light source outgoes. The dust-proof member (the light transmission member) 31 (31Y, 31M, 31C, and 31K) is attached to the exposure unit 3 in a state where the dust-proof member 31 is in contact with an outside or an inside of the opening. Thus, the exposure unit 3 exposes the drum 1 to the laser beam L in such a way that the drum 1 is irradiated with the laser beam L that is emitted from the light source and then passed through the dust-proof member 31. Further, a reservoir portion 32 (32*a* and 32*b*) having a recessed shape is formed on the optical box 30 to store a substance removed by a cleaning member (described below).

The developing unit 4 has the capability of developing an electrostatic latent image formed on the surface of the drum 1 with toner serving as a developer. The electrostatic transfer unit 5 (hereinafter, referred to as "transfer member 5") has the capability of transferring a toner image formed on the drum 1 onto a sheet material S, which is a recording medium serving as a transferred member. For example, paper, OHP sheet, and cloth are representative examples of the sheet material S.

Further, the image forming apparatus 100 includes a cleaning unit 6 for removing toner remaining on the surface of the drum 1 after the transfer operation.

The drum 1 is, for example, constituted by an aluminum cylinder with an organic photoconductive layer (OPC photosensitive member) applied to an outer circumferential surface thereof. The drum 1 is rotatably supported at both end portions thereof by support members (not illustrated). A drum coupling 47 (see FIG. 8) disposed at one of the end portions receives a driving force from a driving motor (not illustrated). When the driving force is transmitted from the driving motor to the drum 1 via the drum coupling 47, the drum 1 rotates in the counterclockwise direction illustrated in FIG. 1.

The charging unit 2 according to the present exemplary embodiment is a contact charging type. More specifically, the charging unit 2 is a conductive roller having a roller shape. The charging roller 2 is brought into contact with the surface of the drum 1. Then, the charging unit 2 uniformly charges the surface of the drum 1 in a state where a charging bias voltage is applied to the charging roller 2.

Each developing unit 4 includes a toner container (see FIG. 7) for storing toner of a corresponding one of yellow, magenta, cyan, and black colors (hereinafter, referred to as Y, M, C, and K, respectively). Each toner container 41 is a developer containing portion that stores the developer (toner) to be supplied to a developing roller 40. The toner in each toner container 41 is supplied to a toner supply roller 43.

The toner supply roller 43 cooperates with a developing blade 44 being pressed in contact with an outer circumferential surface of the developing roller 40 (which serves as a developer bearing member that bears the developer (toner)), so that toner is applied to the outer circumferential surface of the developing roller 40 and the toner is electrified.

When a developing bias is applied to the developing roller 40, toner adheres to a latent image formed on the drum 1 and a toner image is formed thereon. The developing roller 40 is arranged to be opposed to and make contact with the drum 1. The developing unit 4 and the drum 1 are integrated with each other to form a process cartridge P (PY, PM, PC, or PK).

As described above, the process cartridge P is known as one of the cartridge types, in which an image bearing member unit including a photosensitive member (image bearing member) on which a latent image is to be formed, and a developer bearing member unit including a developing roller (developer bearing member) that bears a developer for developing the latent image are integrated with each other. The present exemplary embodiment describes the process cartridge P as an example of a cartridge. Further, as another cartridge type, there is known a developing cartridge that does not include a photosensitive drum and is constituted by a developer bearing member unit only. In the present exemplary embodiment, the cartridge includes at least one of the image bearing member unit and the developer bearing member unit.

Using these cartridges enables a user to perform maintenance work for the apparatus by himself/herself without relying on a service engineer.

<Full-Color Image Formation>

An operation of forming a full-color image is as follows. The drum 1 of each cartridge P is driven to rotate in the direction indicated by the arrow "A" (the counterclockwise direction) in FIG. 1 at a predetermined control speed. The charging roller 2 rotates so as to follow the rotation of the drum 1. Further, the transfer member 5 is driven to rotate in the clockwise direction indicated by an arrow (i.e., a forward direction that follows the rotation of the drum 1) at a speed corresponding to the speed of the drum 1.

The transfer member 5 is a dielectric endless belt that is flexible and is looped and stretched around a driving roller 5*a*, a secondary transfer opposed roller 5*b*, and a tension roller 5*c*. The endless belt that constitutes the transfer member 5 extends in a direction substantially similar to a moving direction of a drawer member 13 (described below). The endless belt further extends in an axial direction (longitudinal direction) of the drum 1.

The developing roller 40 (see FIG. 7) and the toner supply roller 43 are driven to rotate at respective predetermined control speeds. In synchronization with this driving operation, a predetermined charging bias is applied to the charging roller 2 in each cartridge P at a control timing predetermined for each cartridge P. Thus, the surface of the drum 1 is uniformly charged by the charging roller 2 to a predetermined polarity and potential. The exposure device 3 exposes the surface of the drum 1 of each cartridge P with the laser beam L according to an image signal of a corresponding one of Y, M, C, and K. Thus, an electrostatic latent image is formed on the surface of the drum 1 of each cartridge P according to the image signal of the corresponding color.

Then, in each cartridge P, the developing roller 40 develops the electrostatic latent image formed on the surface of the drum 1 as a developer image. In each cartridge P, a predetermined developing bias is applied to the developing roller 40 at a predetermined control timing. Through the above-described electrophotographic image forming process, a Y color developer image corresponding to a Y color component of a full-color image is formed on the drum 1 of a cartridge PY.

Then, the developer image is primarily transferred onto the transfer member 5 at a primary transfer nip portion which is a contact portion in which the drum 1 and the transfer member 5 are in contact with each other. A primary transfer roller 12 is in press-contact with the drum 1 via the transfer member 5 positioned between them. These members forms the primary transfer nip portion. In a similar manner, an M color developer image, a C color developer image, and a K color developer image are primarily transferred onto the transfer member 5 via the drum 1 in a cartridge PM, a cartridge PC, and a cartridge PK, respectively.

Thus, by combining developer images of four colors of Y, M, C, and K, a non-fixed full color developer image is formed on the transfer member 5. The color order of the developer images to be successively transferred and superimposed on the transfer member 5 is not limited to the above-described order. In each cartridge P, the developer remaining on the drum surface after the primary transfer of the developer image onto the transfer member 5 is removed and sent to a waste toner container 7 (see FIG. 7) by the cleaning unit (blade) 6.

On the other hand, a feeding roller 18 is driven at a predetermined control timing to feed the recording medium S (the transferred member) stacked and stored in a feeding cassette 17. Then, at a predetermined control timing, the recording medium S is guided by a registration roller pair 19 to a secondary transfer nip portion which is a contact portion in which the transfer member 5 and a secondary transfer roller 29 (hereinafter, referred to as "roller 29") are is contact with each other.

A secondary transfer bias, which has a predetermined potential and a charging polarity opposed to that of the developer, is applied to the secondary transfer roller 29 at a predetermined control timing. Thus, while the recording medium S is held and conveyed at the secondary transfer nip portion, the developer image of four-colors superimposed on the transfer member 5 is secondarily transferred onto the surface of the recording medium S. The recording medium S having passed through the secondary transfer nip portion is separated from the surface of the transfer member 5 and guided to a fixing apparatus 20 in which the recording medium S is heated and pressed at a fixing nip portion.

Through the above-described operation, color mixing of the developer images of the respective colors and fixing of the composite image on the recording medium S is realized. Subsequently, the recording medium S outgoes from the fixing apparatus 20. A discharge roller pair 23 discharges the recording medium S, as a full-color image product, to a discharge tray 24.

In the present exemplary embodiment, the transfer member 5 is positioned above the drum 1 and the exposure unit 3 including the dust-proof member (the light transmission member) 31 is disposed below the drum 1 in the gravity direction. Further, the feeding cassette 17 is disposed below the exposure unit 3. As described above, providing the transfer member 5 and the feeding cassette 17 on the upper side and the lower side of the drum 1, respectively allows the non-fixed developer images of Y, M, C, and K formed on the transfer member 5 to be immediately transferred onto the recording medium S via the secondary transfer roller 29. Accordingly, the above-described configuration is advantageous in that the time required to output an initial printed product is short.

<Movable Member>

In the present exemplary embodiment, the technical term "apparatus main body" includes various members (or parts) that constitute the image forming apparatus 100 except for the drawer member (i.e., a movable member) 13 and relevant members (or parts) fixed to or attachable/detachable to/from the drawer member 13. In the present exemplary embodiment, the drawer member (the movable member) 13 is configured to place a cartridge therein and be movable between an image forming position, which is located in the apparatus main body, at which the cartridge is usable for an image forming operation and an attachment/detachment position, which is located outside the apparatus main body, at which the cartridge is attachable or detachable As illustrated in FIG. 2, the drawer member 13 is provided to be linearly movable with respect to the apparatus main body substantially in the horizontal direction (the direction indicated by an arrow D1 or D2). In other words, the drawer member 13 is provided to be capable of being inserted into or pulled out from the apparatus main body. The drawer member 13 is capable of being moved between the image forming position where the drawer member 13 is located inside the apparatus main body (the inside position illustrated in FIG. 1) and the attachment/detachment position where the drawer member 13 is pulled outside the apparatus main body (the outside position illustrated in FIG. 2).

In a state where the drawer member 13 is in the outside position, a user installs the cartridge P (PY, PM, PC, or PK) in the drawer member 13 substantially in the gravity direction (the direction indicated by an arrow "C" in FIG. 2). In the installed position of the cartridge P, the longitudinal direction of the cartridge P (the axial direction of the drum 1) is perpendicular to the moving direction of the drawer member 13. The four cartridges PY, PM, PC, and PK are aligned in the moving direction of the drawer member 13.

These cartridges P move in the apparatus main body together with the drawer member 13 in the state where the cartridges P are installed in the drawer member 13. Further, if a door 10 is closed after the drawer member 13 has moved in the apparatus main body, the respective cartridges P are placed at predetermined positions (image forming positions or image formable positions) in the apparatus main body.

As described above, the image forming apparatus 100 according to the present exemplary embodiment enables a user to integrally install the four cartridges P in the apparatus main body and integrally pull the four cartridges P out of the apparatus main body. Accordingly, compared to an image forming apparatus having a configuration in which the cartridges P are separately installed in the apparatus main body, the image forming apparatus 100 according to the present exemplary embodiment is excellent in workability in replacing the cartridges P.

<Installing Portion of Movable Member>

Figure 3:
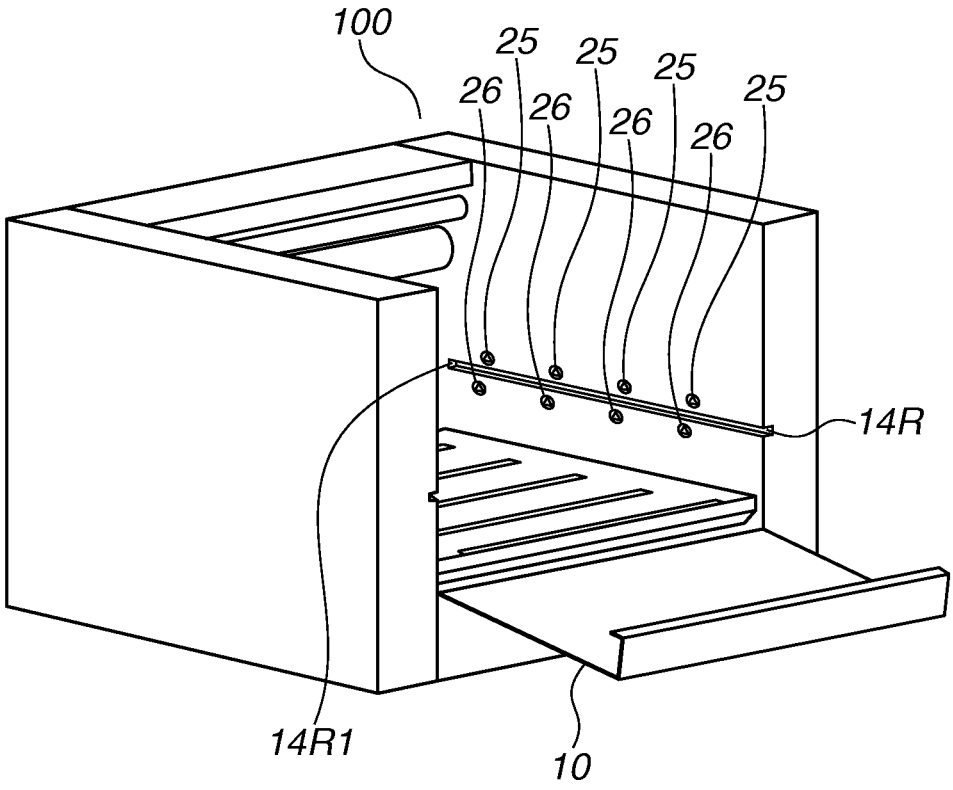
FIG. 3 illustrates a frontal right side of a drawer unit installation portion in the main body of the image forming apparatus according to the first exemplary embodiment.
Figure 4:
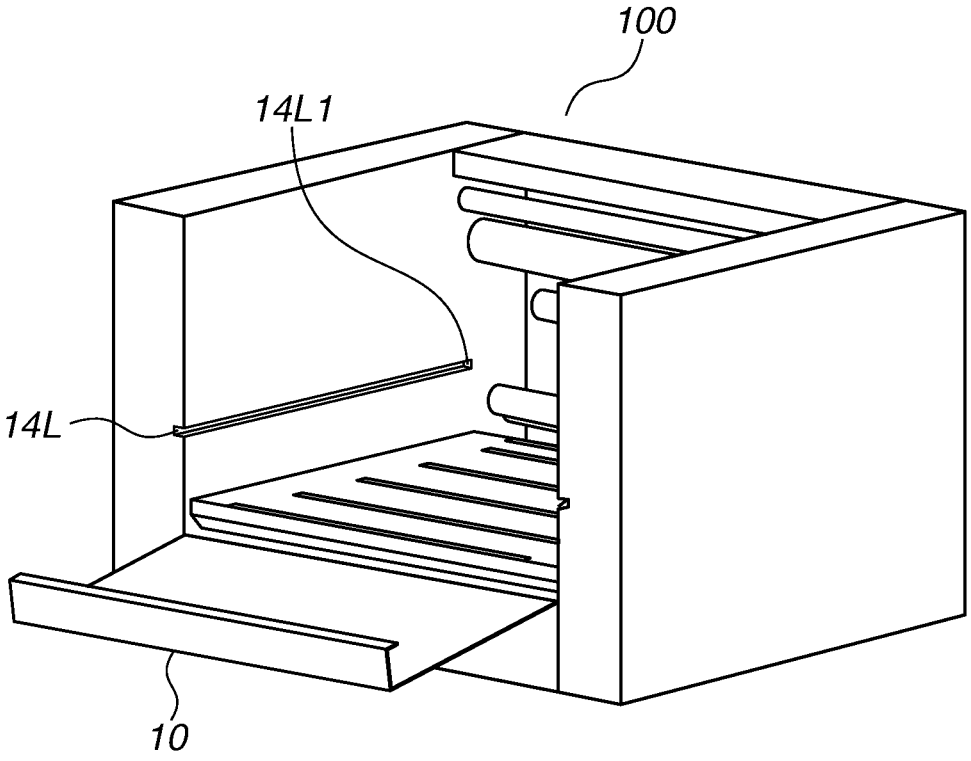
FIG. 4 illustrates a frontal left side of the drawer unit installation portion in the main body of the image forming apparatus according to the first exemplary embodiment.

Next, a configuration of an installing portion of the drawer member (the movable member) 13 in the apparatus main body will be described with reference to FIGS. 3 and 4. FIGS. 3 and 4 are perspective views illustrating the installing portion of the drawer member 13 in the main body of the image forming apparatus 100 according to the present exemplary embodiment. In FIGS. 3 and 4, part of the members (parts) that constitute the apparatus main body, such as the transfer member 5 is not illustrated so that the configuration of the installing portion can be easily understood. Further, FIGS. 3 and 4 are perspective views illustrating the installing portion seen from different directions.

A pair of guide members 14R and 14L for guiding the drawer member 13 in a predetermined moving direction is provided opposing each other on an inner wall surface of a frame of the apparatus main body. These guide members 14R and 14L guide a plurality of guided members 13*a*, 13*b*, 13*c*, and 13*d* (see FIGS. 5 and 6), which will be described below, of the drawer member 13. Each of the guide members 14R and 14L has a channel-like cross section. Further, the guide members 14R and 14L are provided so as to extend substantially in the horizontal direction from the vicinity of an inlet of the apparatus main body (the vicinity of the door 10) to a rear side thereof so that the drawer member 13 can be guided from a position where the drawer member 13 is pulled outside the apparatus main body to a position where the drawer member 13 is stored inside the apparatus main body.

Further, as illustrated in FIG. 3, drum coupling members 25 for transmitting a driving force to the drum 1 are arranged above the guide member 14R at equal intervals in the horizontal direction. Further, developing coupling members 26 for transmitting a driving force to the developing roller 40 are arranged below the guide member 14R at equal intervals in the horizontal direction. A driving force generated by a driving source (not illustrated) is transmitted to the cartridge P via the drum coupling members 25 and the developing coupling members 26. The drum coupling members 25 and the developing coupling members 26 are configured to retract into the side wall while the door 10 is opened, and to advance toward the cartridge P in conjunction with an operation of closing the door 10.

<Details of Movable Member>

Figure 5:
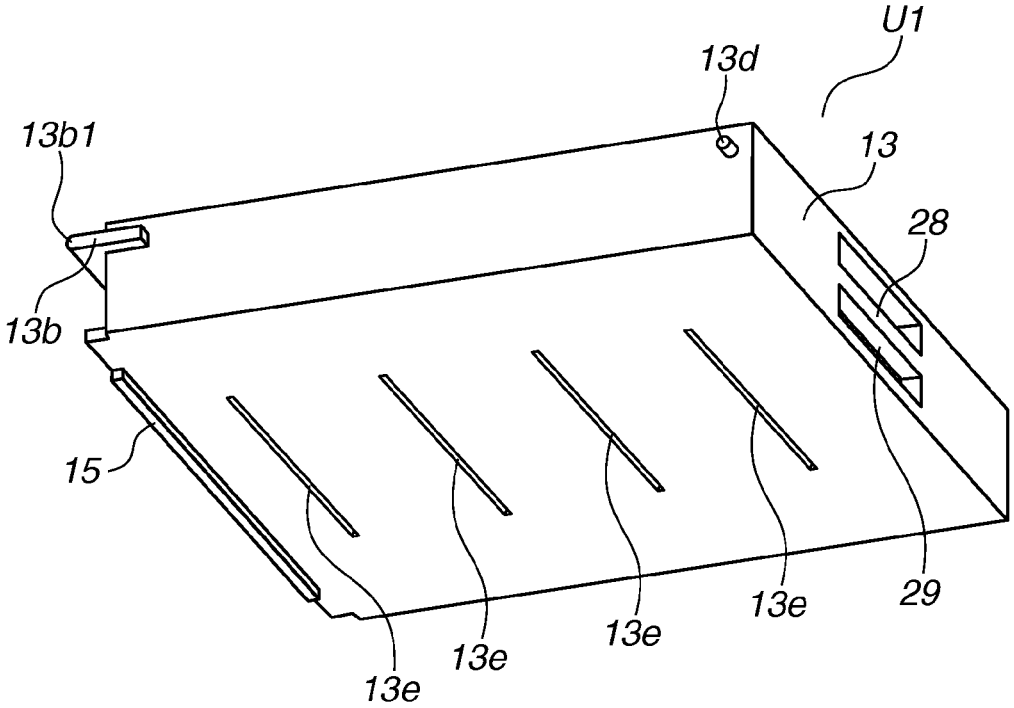
FIG. 5 is a perspective view illustrating the drawer unit according to the first exemplary embodiment, which is seen from one side thereof.
Figure 6:
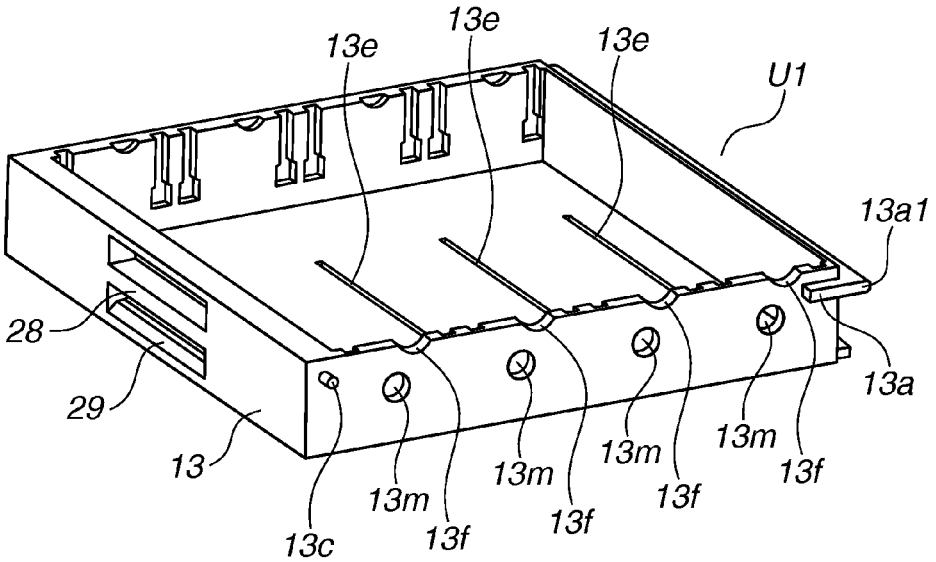
FIG. 6 is a perspective view illustrating the drawer unit according to the first exemplary embodiment, which is seen from the other side.

Next, the drawer member (the movable member) 13 will be described with reference to FIGS. 5 and 6. FIG. 5 is a perspective view illustrating the drawer unit U1 of the image forming apparatus 100 according to the present exemplary embodiment. FIG. 6 is a perspective view illustrating the drawer unit U1 seen from a direction different from that of FIG. 5.

The guided members 13*a*, 13*b*, 13*c*, and 13*d* are provided at four corners of the drawer member 13, so as to be guided by the guide members 14R and 14L of the apparatus main body. The guided members 13*a* and 13*c* are guided by the guide member 14R. The guided members 13*b* and 13*d* are guided by the guide member 14L. The guided members 13*a* and 13*b* are configured to have a shape that protrudes from the outside of the side surface. The guided members 13*a* and 13*b* extend in the pull-out direction to prevent the drawer member 13 from leaning at the pulled-out position. Further, each of the guided members 13*c* and 13*d* is configured to have a columnar shape so as to protrude from the outside of the side surface.

Further, a gripping member 28 (portion to be gripped by a user) is provided at an end portion of the drawer member 13 to allow the user to operate the drawer unit U1. Further, a recessed portion 29 is provided below the gripping member 28 so as to make contact with a pressing member 10*a* provided on the door 10. The pressing member 10*a* makes contact with the recessed portion 29 and presses the drawer unit U1 to ensure the positioning of the drawer unit U1 in the main body of the apparatus 100 (as described in detail below).

A cleaning member 15 (see FIG. 5) is attached to a bottom surface of the drawer member 13 on the other end portion. In the present exemplary embodiment, the cleaning member 15 is made of, for example, nonwoven fabric, felt, or flocking member. The cleaning member 15 is in contact with the surface of the dust-proof member 31 of the exposure unit 3 (the surface opposing the drawer member (the movable member) 13) with a predetermined pressure. Thus, as the drawer unit U1 moves, the cleaning member 15 cleans the surface of the dust-proof member 31 (described in detail below).

Further, the drawer member 13 includes a plurality of installing portions 13*f* (see FIG. 6) that is provided along a line to install the cartridges P (described in detail below). A slit 13*e* is provided at a lower portion of each of the installing portions 13*f* to allow the light emitted from the exposure unit 3 to pass and travel toward the drum 1. Further, as illustrated in FIG. 6, the drawer member 13 includes opening portions 13*m* through which the above-described developing coupling members 26 advance. Each of the developing coupling member 26 advances through a corresponding opening portion 13*m* in conjunction with an operation of closing the door 10. As described above, the drawer unit U1 is configured to include the drawer member 13 and the cleaning member 15.

<Cartridge>

Figure 8:
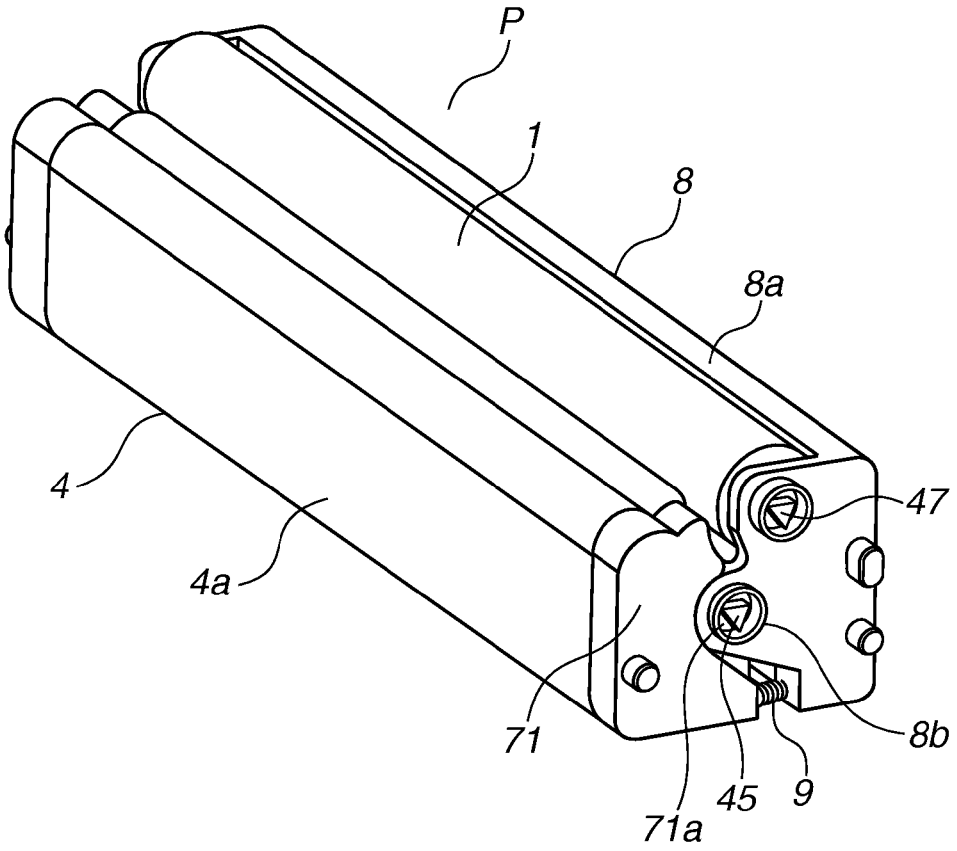
FIG. 8 illustrates the cartridge according to the first exemplary embodiment, which is seen from a driving side thereof.
Figure 9:
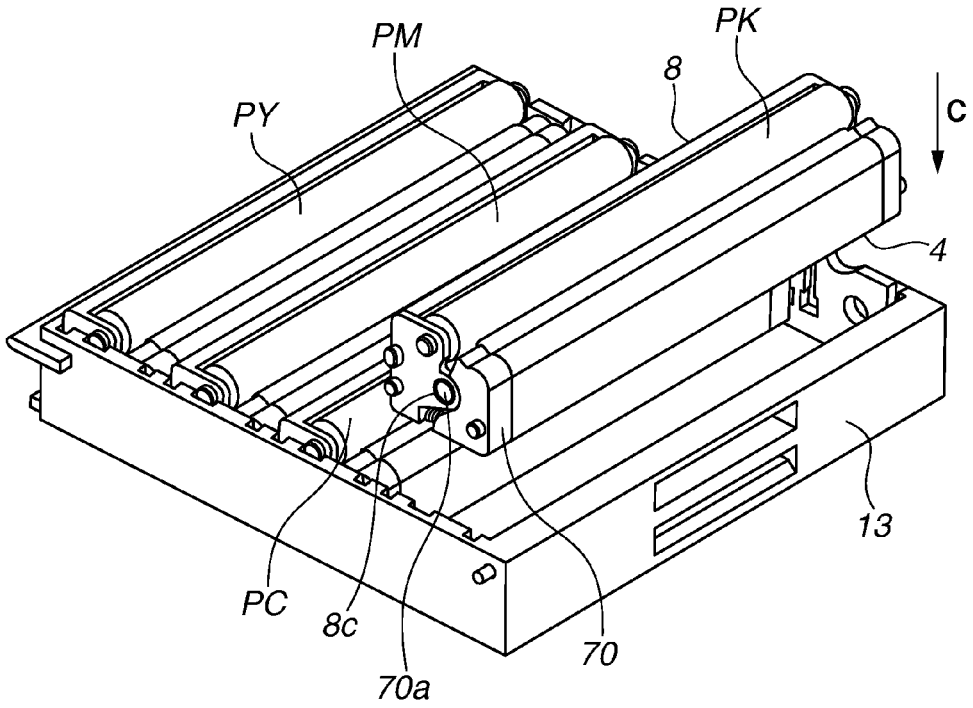
FIG. 9 illustrates the cartridge according to the first exemplary embodiment in a state where the cartridge is being installed in the drawer unit, which is seen from a non-driving side thereof.

Next, the process cartridge P to be installed in the drawer member 13 will be described with reference to FIGS. 7 through 9. FIG. 7 is a schematic cross-sectional view illustrating the process cartridge P according to the present exemplary embodiment. FIG. 8 is a perspective view illustrating the cartridge P according to the present exemplary embodiment. FIG. 9 is a perspective view illustrating a state where the process cartridge P according to the present exemplary embodiment is being installed in the drawer member 13.

The process cartridge P is composed of a photosensitive member unit 8 and the developing unit 4. The photosensitive member unit 8 is composed of the drum 1, a photosensitive member frame 8*a* that supports the drum 1, the charging unit 2, the cleaning unit 6, and the waste toner container 7 that stores toner removed by the cleaning unit 6. The developing unit 4 is composed of the developing roller 40, a developing frame 4*a* that supports the developing roller 40, the toner supply roller 43, the developing blade 44, the toner container 41 that stores toner usable for image formation, and a conveyance member 48 for supplying toner from the toner container 41.

As described above, the conveyance member 48 supplies toner from the toner container 41 to the toner supply roller 43. The toner supply roller 43, and the developing blade 44 being pressed in contact with the outer circumferential surface of the developing roller 40 apply toner to the outer circumferential surface of the developing roller 40 and the toner is electrified. When a developing bias is applied from the apparatus main body to the developing roller 40, toner adheres to a latent image formed on the drum 1 to form a toner image. After the toner image developed on the drum 1 is transferred onto the sheet material S, toner remaining on the surface of the drum 1 is removed by the cleaning unit 6, and stored in the waste toner container 7.

If the toner in the toner container 41 has been completely consumed, a user can replace the process cartridge P by a new one to perform a printing operation again.

As illustrated in FIG. 8, a first coupling member 47 is rotatably supported at an end portion of the process cartridge P to receive a driving force from the drum coupling members 25 provided on the apparatus main body. A second coupling member 45 is also rotatably supported at the end portion to receive a driving force from the developing coupling members 26.

The first coupling member 47 is provided at one end of the drum 1. The drum 1 is rotated by the driving force received by the first coupling member 47 from the apparatus main body. The driving force received by the second coupling member 45 is transmitted to the developing roller 40, the toner supply roller 43, and the conveyance member 48 via an intermediate gear (not illustrated) to rotate the developing roller 40, the toner supply roller 43, and the conveyance member 48.

An outer circumference of the second coupling member 45 is surrounded by a cylindrical rib to form an engaging portion 71*a*. The engaging portion 71*a* is provided on a side cover 71, which is fixed to the outside of the toner container 41. The second coupling member 45 is rotatably supported with respect to the engaging portion 71*a*. Further, an engaging portion 70*a* (see FIG. 9) is provided on the opposite side of the engaging portion 71*a* (see FIG. 8). The engaging portion 70*a* is provided on a side cover 70. Both of the engaging portions 71*a* and 70*a* are provided on the developing unit 4.

Further, the photosensitive member frame 8*a* (see FIG. 8) includes a hole 8*b* (see FIG. 8) that supports the engaging portion 71*a* (see FIG. 8), and a hole 8*c* (see FIG. 9) that supports the engaging portion 70*a* (see FIG. 9). When the holes 8*b* and 8*c* provided on the photosensitive member frame 8*a* engage with the engaging portions 71*a* and 70*a* provided on the developing unit 4, respectively, the photosensitive member unit 8 and the developing unit 4 are coupled to each other.

In the present exemplary embodiment, the engaging portions 71*a* and 70*a* are configured to be movable (rotatable) with respect to the holes 8*b* and 8*c*, respectively. Thus, the developing unit 4 is movable with respect to the photosensitive member unit 8. More specifically, the developing roller 40 is configured to be movable (rotatable) with respect to the drum 1. Further, as illustrated in FIGS. 7 and 8, a spring 9 (i.e., an urging member) is provided between the photosensitive member unit 8 and the developing unit 4. The spring 9 presses the developing roller 40 against the drum 1 with a predetermined pressure.

<Installation of Cartridge in Movable Member>

Installation of the cartridge P (PY, PM, PC, or PK) in the drawer member (the movable member) 13 will be described with reference to FIG. 9. FIG. 9 is a perspective view illustrating a state where the cartridge P according to the present exemplary embodiment is being installed in the drawer member 13. Each of the cartridges PY, PM, PC, and PK is installed in a corresponding one of the four installing portions 13*f* (see FIG. 6) provided in the drawer member 13. More specifically, a user installs the cartridge P in the direction indicated by an arrow "C" (see FIG. 9), namely substantially in the gravity direction.

<Installation of Drawer Unit U1 in Apparatus Main Body>

Figure 10:
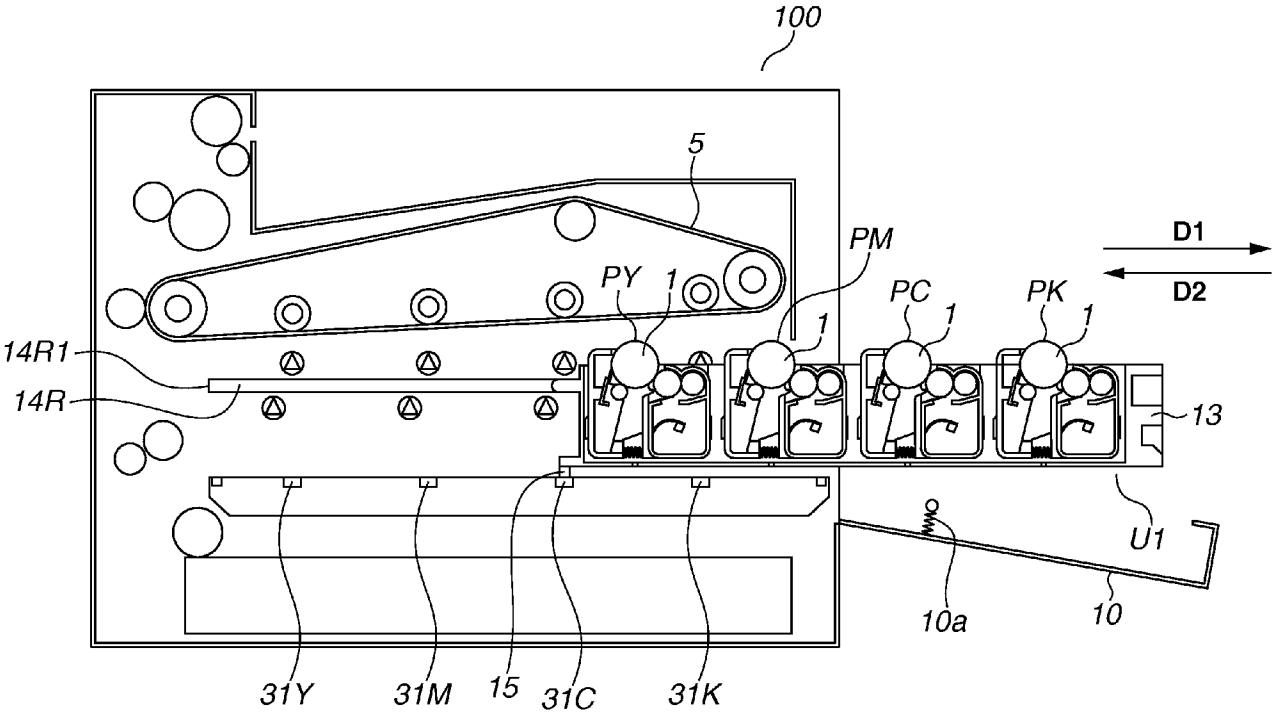
FIG. 10 is a cross-sectional view illustrating a state where the drawer unit according to the first exemplary embodiment is being inserted into the main body of the image forming apparatus.

An operation of installing the drawer unit U1 including the drawer member 13 and the cleaning member 15 in the apparatus main body will be described with reference to FIG. 10. FIG. 10 is a schematic cross-sectional view illustrating a state where the drawer unit U1 according to the present exemplary embodiment is being installed into the apparatus main body. As illustrated in FIG. 10, when the drawer unit U1 is inserted in the direction indicated by an arrow D2, the guided members 13*a*, 13*b*, 13*c*, and 13*d* (see FIGS. 5 and 6) of the drawer member (the movable member) 13 move along the guide members 14R and 14L (see FIGS. 3 and 4) provided in the apparatus main body.

As illustrated in FIG. 10, the intermediate transfer member 5 is configured to retract from the image forming position in response to an operation of opening the door 10. Accordingly, the drum 1 does not frictionally engage with the surface of the intermediate transfer member 5 when the drawer unit U1 is operated.

FIG. 10 is different from FIG. 1 in that FIG. 1 illustrates the door 10 being in a closed state. The operation of closing the door 10 causes the drum coupling members 25 and the developing coupling members 26 (see FIG. 3) to advance forward. Further, the intermediate transfer member 5 moves downward in conjunction with the movement of the door 10. Furthermore, the pressing member 10*a* integrally provided with the door 10 enters the recessed portion 29 provided in the drawer member 13, and presses the drawer unit U1 in the direction indicated by the arrow D2 (see FIG. 2).

This brings front end portions 13*a*1 and 13*b*1 of the guided members 13*a* and 13*b* of the drawer member 13 into contact with rear end portions 14R1 and 14L1 of the guide members 14R and 14L. The above-described operations ensure the positioning of the drawer unit U1 in the apparatus main body. More specifically, the above-described operations ensure the positioning of the cartridge P stored in the drawer unit U1 in the apparatus main body.

<Cleaning of Dust-Proof Member>

Cleaning of the dust-proof member (the light transmission member) 31 (31Y, 31M, 31C, and 31K) will be described with reference to FIGS. 1, 2, and 10. When the drawer unit U1 is pulled out from the position illustrated in FIG. 1 (moved in the direction indicated by the arrow D1), the cleaning member 15 passes on the dust-proof member (the light transmission member) 31 (31Y, 31M, 31C, and 31K) while making contact with the dust-proof member 31, as illustrated in FIG. 10. The dust-proof member 31 is made of a transparent material (e.g., glass or resin).

In this case, the cleaning member 15 removes dust from the dust-proof member 31. If the drawer unit U1 is further pulled out from the position illustrated in FIG. 10 and reaches the position illustrated in FIG. 2, an end portion of the cleaning member 15 in the direction indicated by the arrow D1 reaches a position above the reservoir portion 32*a*, and the dust removed by the cleaning member 15 falls into the reservoir portion 32*a*. Similarly, when the drawer unit U1 is installed into the apparatus main body (moves in the direction indicated by the arrow D2) from the position illustrated in FIG. 2, the drawer unit U1 reaches the position illustrated in FIG. 1 via the state illustrated in FIG. 10. In this case, the dust removed by the cleaning member 15 falls into the reservoir portion 32*b*.

Advantages of the Present Exemplary Embodiment

As described above, the image forming apparatus 100 according to the present exemplary embodiment includes the cleaning member 15 that moves according to the pulling-out or inserting operation of the drawer unit U1 and removes dust from the dust-proof member 31. Further, the image forming apparatus 100 includes the reservoir portion 32 that has a recessed shape and is provided at the starting point and the ending point of a path along which the cleaning member 15 moves so that the dust removed by the cleaning member 15 falls into the reservoir portion 32.

According to the above-described configuration, the dust-proof member 31 can be cleaned by simply pulling out or inserting the drawer unit U1 from or in the apparatus main body. In other words, it is feasible to omit an operation only for cleaning the dust-proof member 31. As a result, the maintainability of the image forming apparatus 100 can be greatly enhanced. Furthermore, storing the dust generated by the cleaning operation in the reservoir portion 32 can prevent the dust from falling or scattering into the image forming apparatus 100. Accordingly, the risk of occurrence of image defects or operation defects can be reduced The reservoir portion 32 is provided in the main body of the image forming apparatus 100 (i.e., the optical box 30), not in the drawer unit U1 (the movable member). The apparatus main body is larger than the drawer unit U1. Therefore, providing the reservoir portion 32 in the apparatus main body is advantageous in that the capacity of the reservoir portion 32 can be made larger. Accordingly, compared to the conventional technique characterized by collecting dust particles in a cartridge storage tray (see Japanese Patent Application Laid-Open No. 2013-228635), the reservoir portion 32 can collect dust particles for a long time. More specifically, the cleaning member 15 can perform the cleaning of the dust-proof member 31 for a long time.

Modification Example of Installation Position of Cleaning Member

Figure 11:
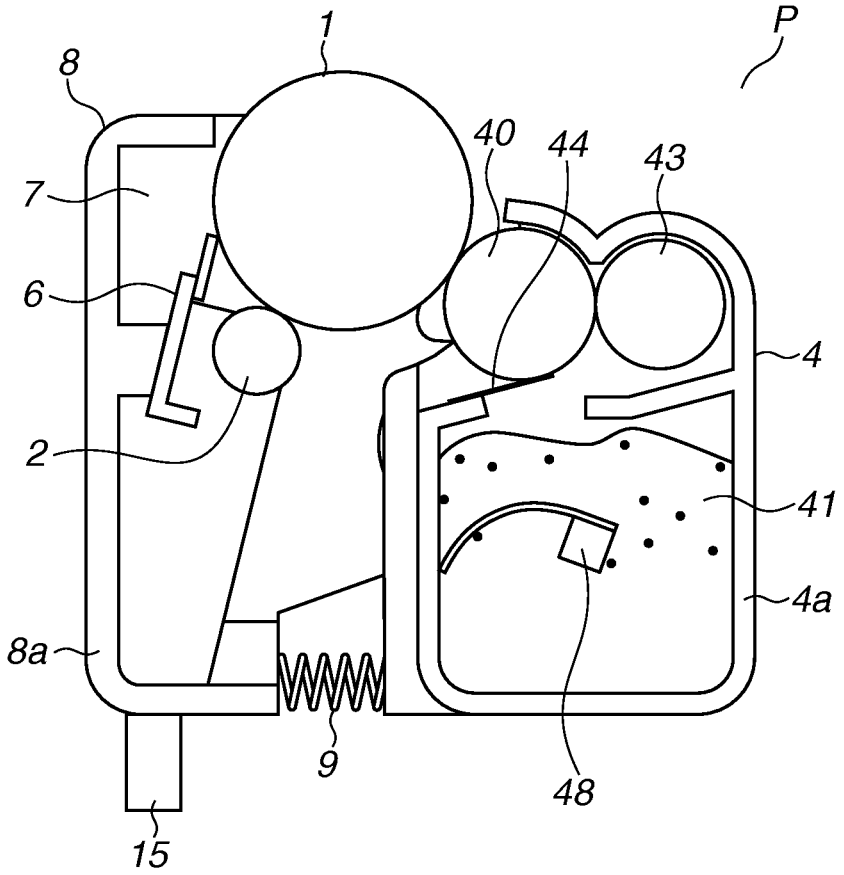
FIG. 11 is a cross-sectional view illustrating a cartridge including a cleaning member as a modification example.
Figure 12:
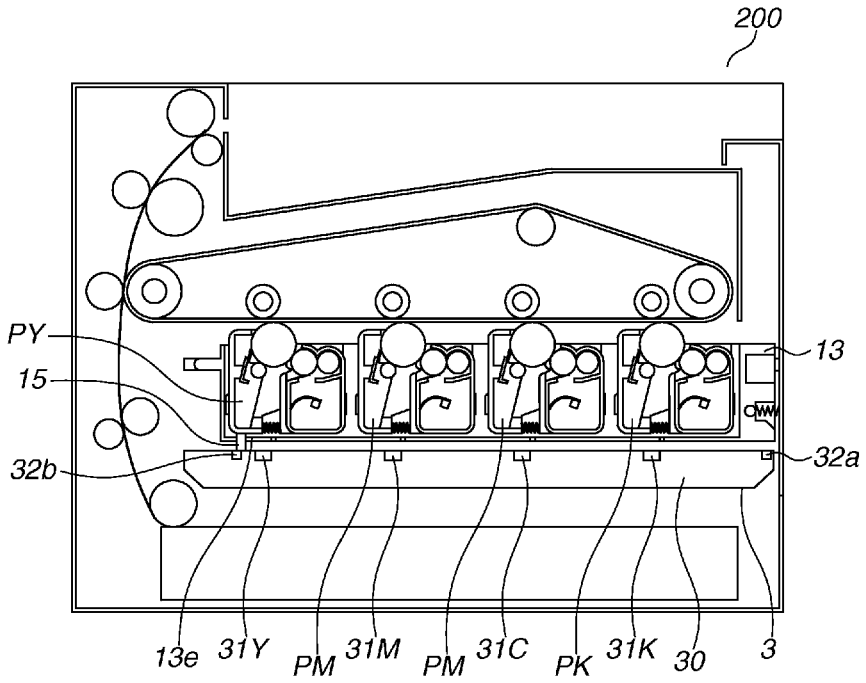
FIG. 12 is a cross-sectional view illustrating an image forming operation performed by the modification example of the image forming apparatus, in which the cleaning member is attached to the cartridge.

A modification example of the installation position of the cleaning member 15 will be described with reference to FIGS. 11 and 12. FIG. 11 is a schematic cross-sectional view illustrating the cartridge P according to the present modification example, which corresponds to FIG. 7. FIG. 12 is a schematic cross-sectional view illustrating the entire configuration of an image forming apparatus 200 according to the present modification example, which corresponds to FIG. 1. Although the cleaning member 15 illustrated in FIG. 1 is attached to the drawer member (the movable member) 13, the cleaning member 15 of the image forming apparatus 200 is attached to the cartridge P as illustrated in FIGS. 11 and 12. In the present modification example, the cleaning member 15 protrudes from the lower surface of the drawer member 13 through the slit 13*e* of the drawer member 13.

Using the above-described configuration allows the cleaning member 15 to be automatically replaced according to the replacement of the cartridge P. More specifically, the cleaning member 15 is replaced before the cleaning capability deteriorates due to its repetitive use. This allows the cleaning member 15 to be used in a state where the cleaning capability is maintained at higher levels.

In FIGS. 11 and 12, the cleaning member 15 protrudes from the lower surface of the drawer member 13 through the slit 13*e*. Alternatively, an opening through which the cleaning member 15 protrudes may separately be provided in addition to the slit 13*e*.

Modification Example with a Plurality of Cleaning Members

Figure 13:
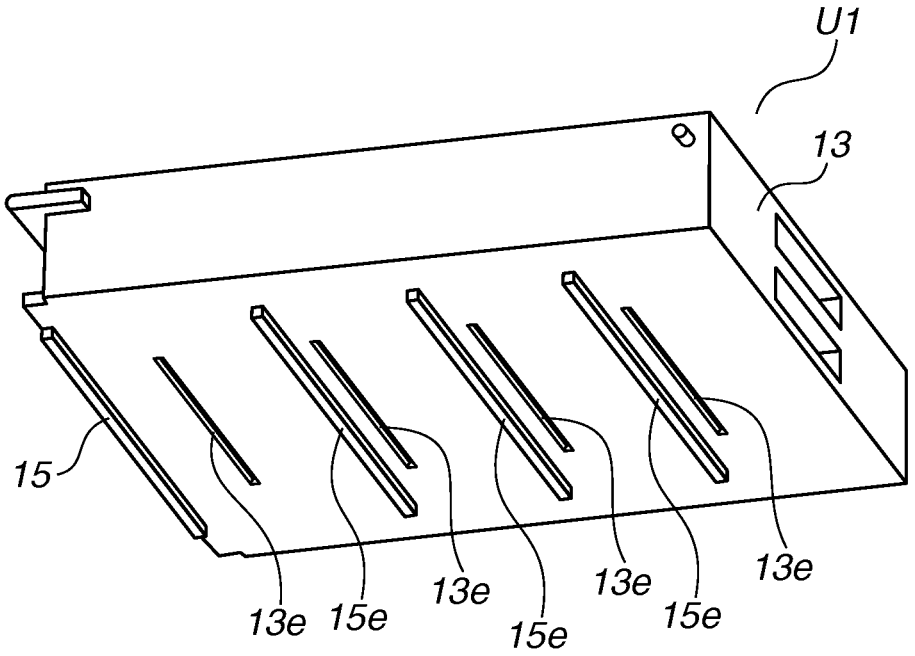
FIG. 13 illustrates a drawer unit including a plurality of cleaning members as a modification example.

A modification example with a plurality of cleaning members will be described with reference to FIG. 13. FIG. 13 is a perspective view illustrating the drawer unit U1 of the image forming apparatus 100 according to the present modification example, which corresponds to FIG. 5. Although only one cleaning member 15 is illustrated in FIG. 5, the number of cleaning members illustrated in FIG. 13 is four. The cleaning members 15 are provided at the starting point, the ending point, and other points of the movement path. When the above-described configuration is employed, a plurality of cleaning members 15 passes on the dust-proof member 31 (except for the dust-proof member 31Y) while the drawer unit U1 makes a single movement. Thus, the dust-proof member 31 can be cleaned more efficiently compared to the above-described example using only one cleaning member. Although the number of the cleaning members illustrated in FIG. 13 is four, the number of the cleaning members may be changed appropriately.

Further, in a case where a plurality of cleaning members 15 is provided, the cleaning members 15 may be provided in both of the drawer member 13 and the cartridge P. More specifically, the cleaning member 15 only has to be provided on at least one of the drawer member 13 and the cartridge P, so that the cleaning member 15 can clean the dust-proof member 31 according to the movement of the drawer member 13.

Modification Example 1 of Shape of Reservoir Portion

Figure 14:
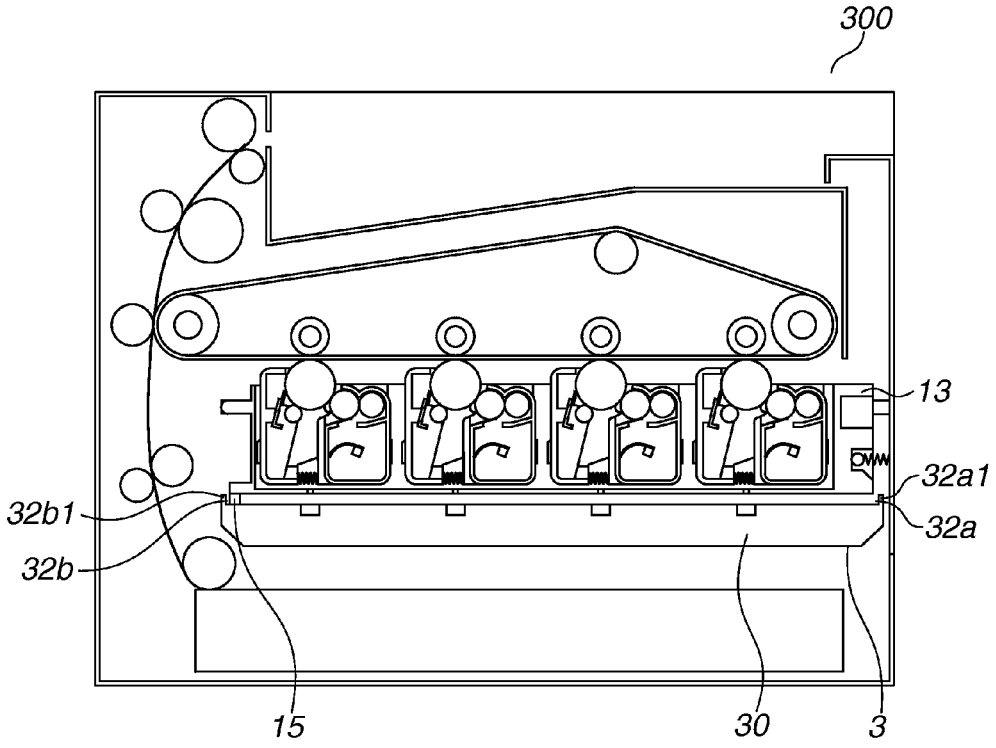
FIG. 14 is a cross-sectional view illustrating an image forming operation performed by a modification example of the image forming apparatus, in which a reservoir portion is formed by protruding portions.

A modification example 1 of the shape of the reservoir 32 will be described with reference to FIG. 14. FIG. 14 is a schematic cross-sectional view illustrating the entire configuration of an image forming apparatus 300 according to the present modification example, which corresponds to FIG. 1. Although the reservoir portion 32 (32*a* and 32*b*) illustrated in FIG. 1 has a recessed shape, the reservoir portion 32 (32*a* and 32*b*) illustrated in FIG. 14 is a space defined by protruding portions 32*a*1 and 32*b*1 of the image forming apparatus 300. Even with the configuration illustrated in FIG. 14, the reservoir portion 32 can attain its goal of preventing toner from scattering into the image forming apparatus.

Modification Example 1 of Cleaning Member Attachment Method

Figure 15:
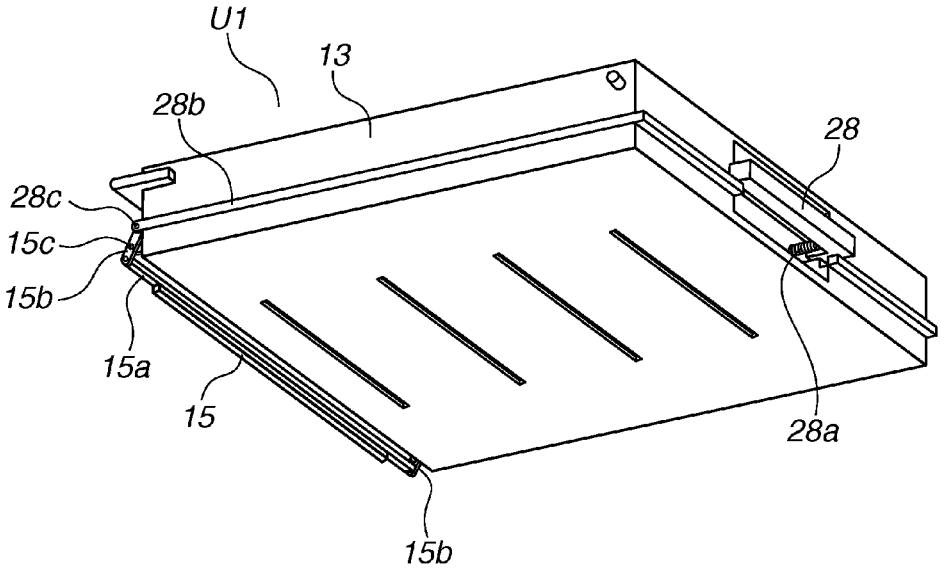
FIG. 15 is a perspective view illustrating a modification example of the drawer unit differentiated in installation of the cleaning member, which is seen from one side thereof.
Figure 16:
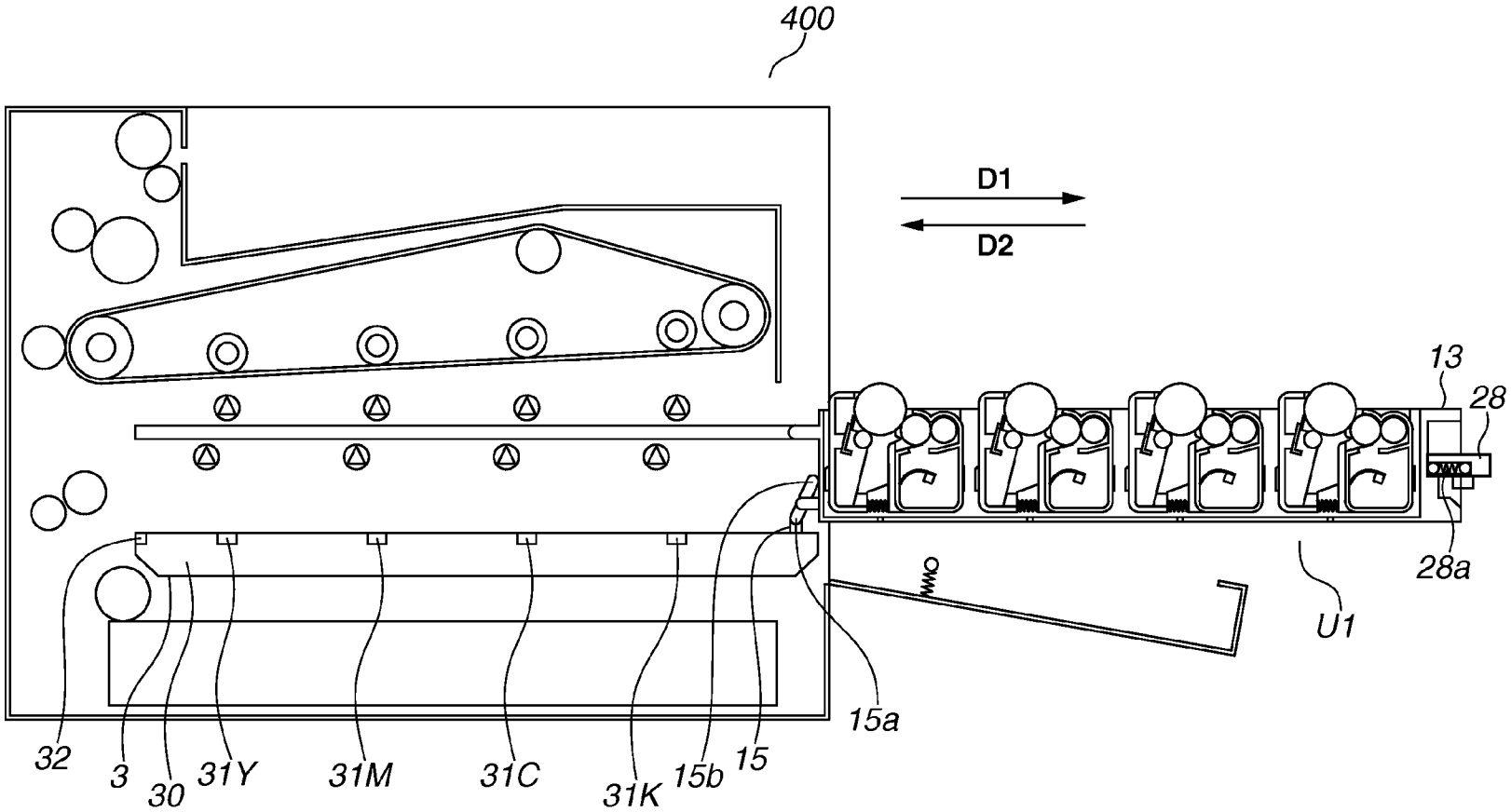
FIG. 16 is a cross-sectional view illustrating the modification example of the drawer unit differentiated in installation of the cleaning member, in an initial stage of being inserted into the main body of the image forming apparatus.
Figure 17:
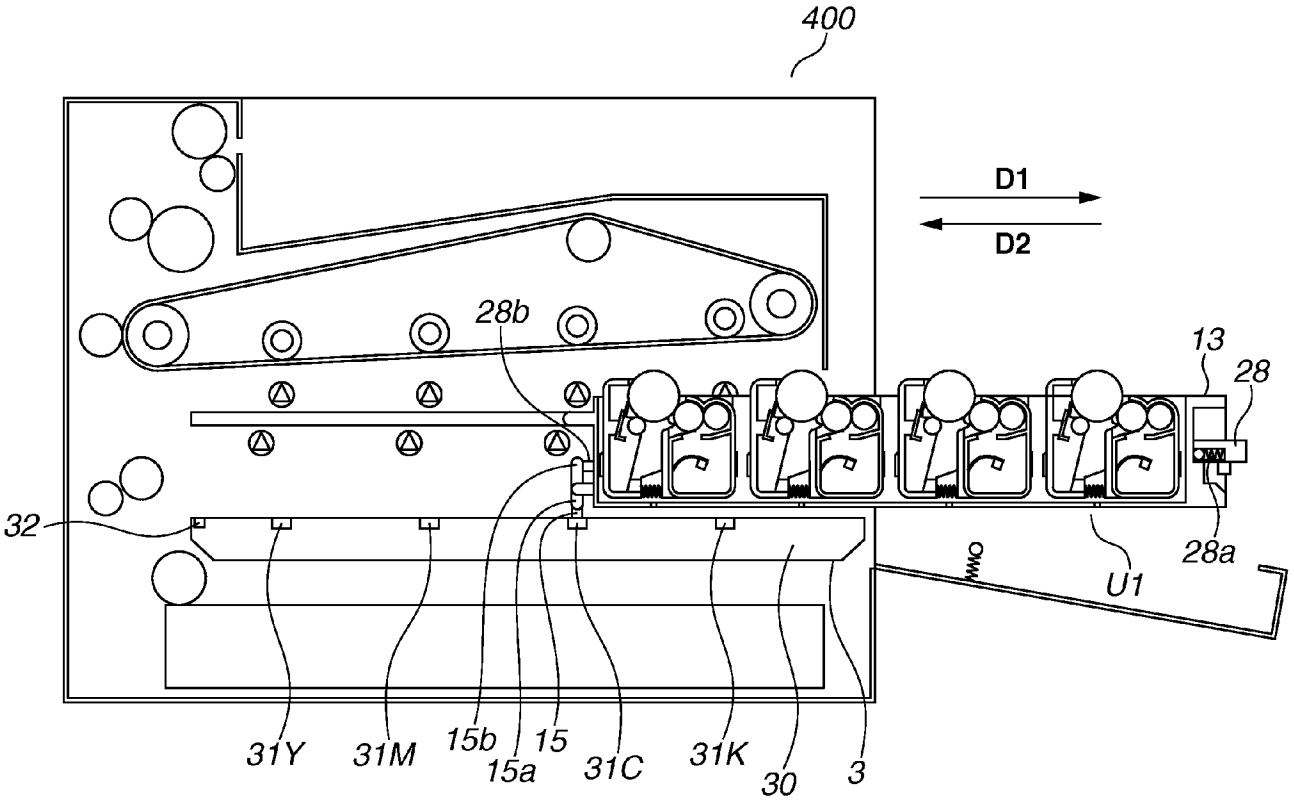
FIG. 17 is a cross-sectional view illustrating the modification example of the drawer unit differentiated in installation of the cleaning member, in an intermediate stage of being inserted into the main body of the image forming apparatus.

A modification example of the method for attaching the cleaning member 15 will be described with reference to FIGS. 15 through 17. FIG. 15 is a perspective view illustrating the drawer unit U1 of an image forming apparatus 400 according to the present modification example, which corresponds to FIG. 5. FIG. 16 is a schematic cross-sectional view illustrating a pulled-out state of the drawer unit U1 of the image forming apparatus 400 according to the present modification example, which corresponds to FIG. 2. FIG. 17 is a schematic cross-sectional view illustrating a state where the drawer unit U1 according to the present modification example is being inserted into the apparatus main body, which corresponds to FIG. 10.

The cleaning member 15 illustrated in FIG. 5, 2, or 10 is directly attached to the drawer member (the movable member) 13 and integrated with the drawer member 13. On the other hand, the cleaning member 15 according to the present exemplary embodiment is attached to the drawer member 13 via a connecting member (a cleaning holder 15*a* or a cleaning link 15*b*). As illustrated in FIGS. 15 through 17, the cleaning member 15 of the image forming apparatus 400 is attached to the cleaning holder 15*a* (see FIG. 15) and is movably held with respect to the drawer member 13 via the cleaning link 15*b* (see FIG. 15) and the gripping member 28 (see FIG. 15).

In FIG. 15, the cleaning holder 15*a* is rotatably held with respect to the cleaning link 15*b* in a rotational axis direction (see FIG. 1) of the drum 1. Further, the cleaning link 15*b* is held to be rotatable around a pivot point 15*c* (see FIG. 15) and movable in the horizontal direction with respect to the drawer member 13. Further, the cleaning link 15*b* is rotatably connected to a link portion 28*b* and a pivot point 28*c* (see FIG. 15) of the gripping member 28. The gripping member 28 is held to be movable in the direction indicated by an arrow D1 or D2 with respect to the drawer member 13.

More specifically, when the gripping member 28 moves with respect to the drawer member 13 in the direction indicated by the arrow D1 or D2, the cleaning link 15*b* rotates around the pivot point 15*c* and moves horizontally along a straight line connecting the pivot point 28*c* and the pivot point 15*c*. The above-described rotation and horizontal movement of the cleaning link 15*b* causes the cleaning holder 15*a* with the cleaning member 15 attached thereto to move with respect to the drawer member 13.

The cleaning link 15*b* is a connecting member that connects the cleaning member 15 to the drawer member 13. The cleaning link 15*b* also connects the cleaning member 15 to the gripping member 18 to cause the cleaning member 15 to move with respect to the drawer member 13, together with the movement of the gripping member 28 with respect to the drawer member 13.

Further, a spring 28*a* is provided between the gripping member 28 and the drawer member 13 and constantly urges the gripping member 28 to the drawer member (the movable member) 13 in the direction indicated by the arrow D1 (see FIG. 16). The force of the spring 28*a* that urges the gripping member 28 in the direction indicated by the arrow D1 is set to be smaller than a resistance force generated when a user inserts the drawer unit U1 into the main body of the image forming apparatus, more specifically, when the user moves the drawer unit U1 in the direction indicated by the arrow D2. Further, the reservoir portion 32 illustrated in FIG. 5, 2, or 10 is positioned at an end portion of the optical box 30 in the direction indicated by the arrow D1 and at another end portion of the optical box 30 in the direction indicated by the arrow D2. On the other hand, the reservoir portion 32 illustrated in FIGS. 15 through 17 is provided only at the end portion of the optical box 30 in the direction indicated by the arrow D2.

Hereinafter, it is assumed that the gripping member 28 is moving in the direction indicated by the arrow D1 (see FIG. 16) with respect to the drawer member 13. More specifically, the gripping member 28 is assumed to be urged by the spring 28*a*. In this case, the cleaning link 15*b* rotates in the clockwise direction. The cleaning member 15 stays at a non-cleaning position (noncontact position) at which the cleaning member 15 is not in contact with the dust-proof member 31 (31Y, 31M, 31C, and 31K). In the state where the cleaning member 15 is located at the non-cleaning position, the cleaning member 15 passes over the dust-proof member 31 without making contact with the dust-proof member 31 even if the drawer unit U1 moves. More specifically, the cleaning member 15 does not clean the dust-proof member 31.

On the other hand, it is now assumed that the gripping member 28 is moving in the direction indicated by the arrow D2 with respect to the drawer member 13, as illustrated in FIG. 17. More specifically, the gripping member 28 is assumed to be moving in the direction opposed to the urging direction of the spring 28*a*. In this case, the cleaning link 15*b* rotates in the counterclockwise direction. The cleaning member 15 stays at a cleaning position (contact position) at which the cleaning member 15 can make contact with the dust-proof member 31 (31Y, 31M, 31C, and 31K). In the state where the cleaning member 15 is located at the cleaning position, the cleaning member 15 passes on the dust-proof member 31 while making contact with the dust-proof member 31, along with the movement of the drawer unit U1. More specifically, the cleaning member 15 cleans the dust-proof member 31.

When a user does not touch the gripping member 28, or when the gripping member 28 is gripped to cause the drawer unit U1 to move in the direction indicated by the arrow D1, the cleaning member 15 stays at the non-cleaning position. On the other hand, if the gripping member 28 is pressed to cause the drawer unit U1 to move in the direction indicated by the arrow D2, the cleaning member 15 stays at the cleaning position. More specifically, only when the drawer unit U1 is inserted into the main body of the image forming apparatus, the cleaning member 15 cleans the dust-proof member 31. Further, the dust removed from the dust-proof member 31 by the cleaning member 15 falls into the reservoir portion 32.

Employing the above-described configuration can reduce the number of times the cleaning member 15 cleans the dust-proof member 31 and prevent wear, thereby extending the lifetime of the cleaning member 15. More specifically, the cleaning capability of the cleaning member 15 can be maintained for a long time. Especially, employing the above-described configuration is effective if the cleaning member 15 can sufficiently clean the dust-proof member (the light transmission member) 31 only with the operation of inserting the drawer unit U1 into the main body of the apparatus in a case where the drawer unit U1 is caused to reciprocate to move to and from the apparatus main body. Further, it becomes feasible to use a rubber blade or an obliquely flocking member that can exhibit the cleaning capability only during movement in one direction. Further, it is unnecessary to provide the reservoir portion 32 at the end portion of the optical box 30 in the direction indicated by the arrow D1. This increases the degree of freedom in arrangement and size of the exposure device 3, thereby achieving the efficient use of space and downsizing of the apparatus.

Modification Example 2 of Cleaning Member Attachment Method

A modification example 2 of the method for attaching the cleaning member 15 will be described with reference to FIGS. 18 through 20. In the above-described configuration of the modification example 1 (see FIGS. 15 through 17), the gripping member 28 is constantly urged to the drawer member 13 by the spring 28*a* in the direction indicated by the arrow D1. Further, the cleaning member 15 cleans the dust-proof member 31 only when the drawer unit U1 moves in the direction indicated with the arrow D2, more specifically, only when the drawer unit U1 is inserted into the main body of the image forming apparatus.

Figure 18:
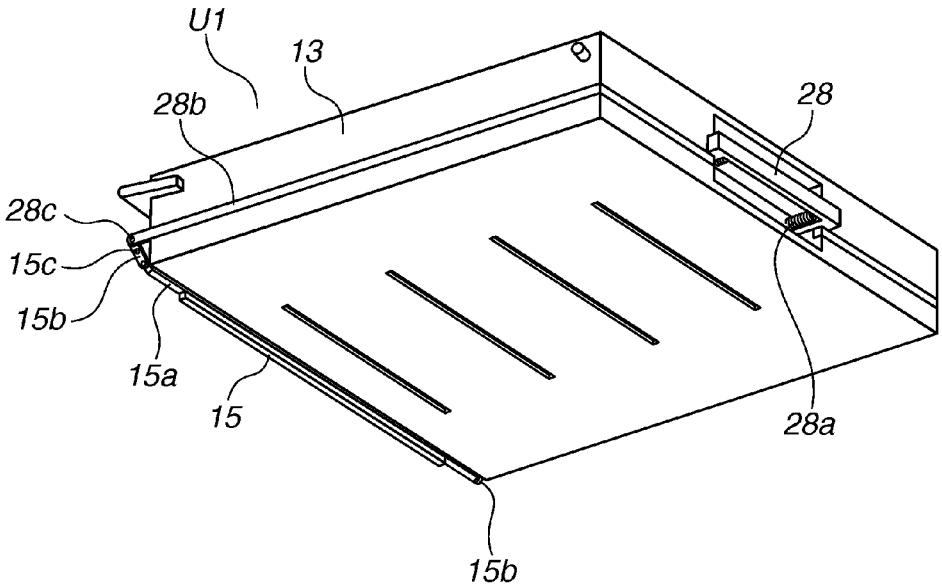
FIG. 18 is a perspective view illustrating a modification example of the drawer unit configured to perform a cleaning operation only when the drawer unit is pulled out, which is seen from one side thereof.
Figure 19:
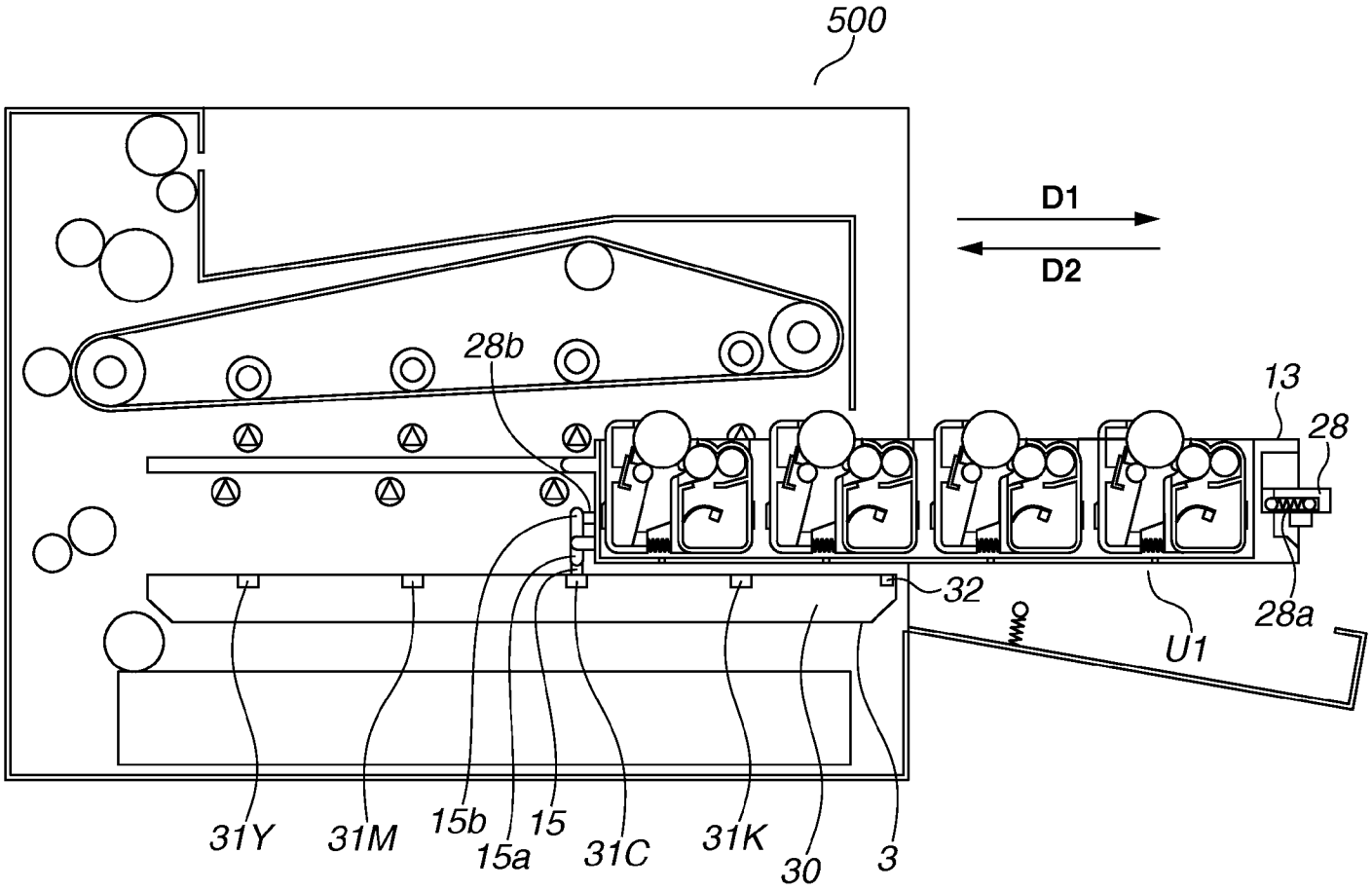
FIG. 19 is a cross-sectional view illustrating the modification example of the drawer unit configured to perform a cleaning operation only when the drawer unit is pulled out, in a state where the drawer unit is being inserted into the main body of the image forming apparatus.
Figure 20:
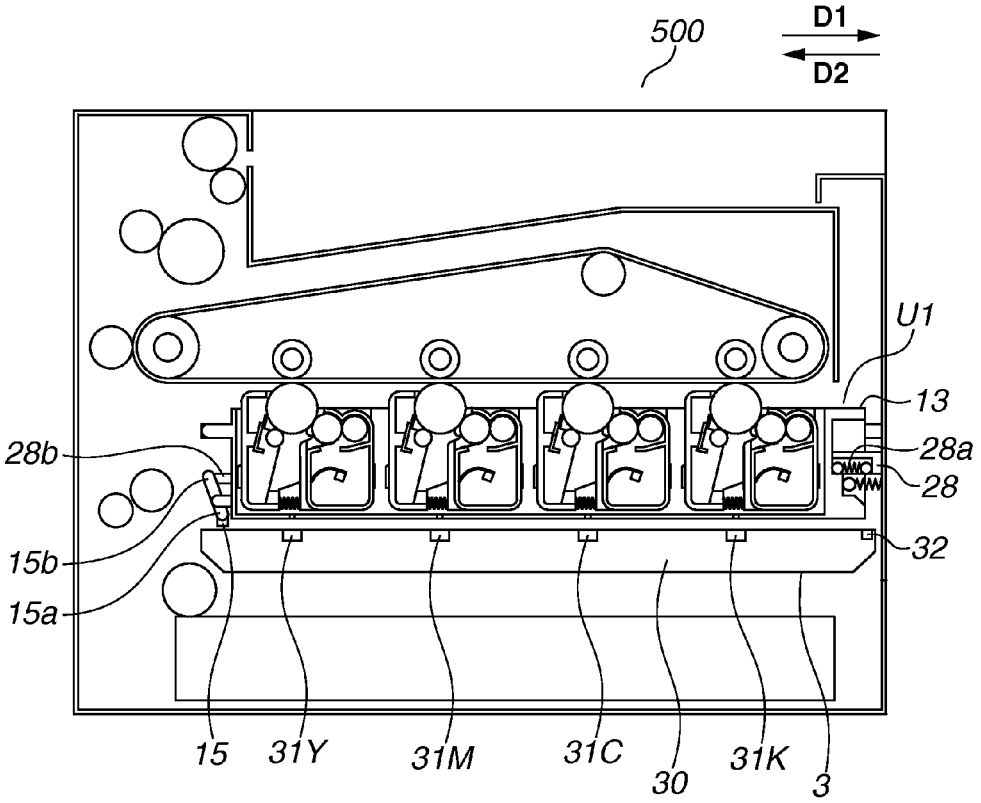
FIG. 20 is a cross-sectional view illustrating an image forming operation performed by the image forming apparatus in which the modification example of the drawer unit configured to perform a cleaning operation only when the drawer unit is pulled out is installed in the main body.

On the other hand, in the modification example 2 illustrated in FIGS. 18 through 20, the gripping member 28 of an image forming apparatus 500 is constantly urged to the drawer member 13 by the spring 28*a* in the direction indicated by the arrow D2. Further, the cleaning member 15 cleans the dust-proof member 31 when the drawer unit U1 moves in the direction indicated by the arrow D1, more specifically, only when the drawer unit U1 is pulled out from the main body of the image forming apparatus. FIGS. 18, 19, and 20 correspond to FIGS. 15, 16, and 17, respectively.

Modification Example of Exposure Unit

Figure 21:
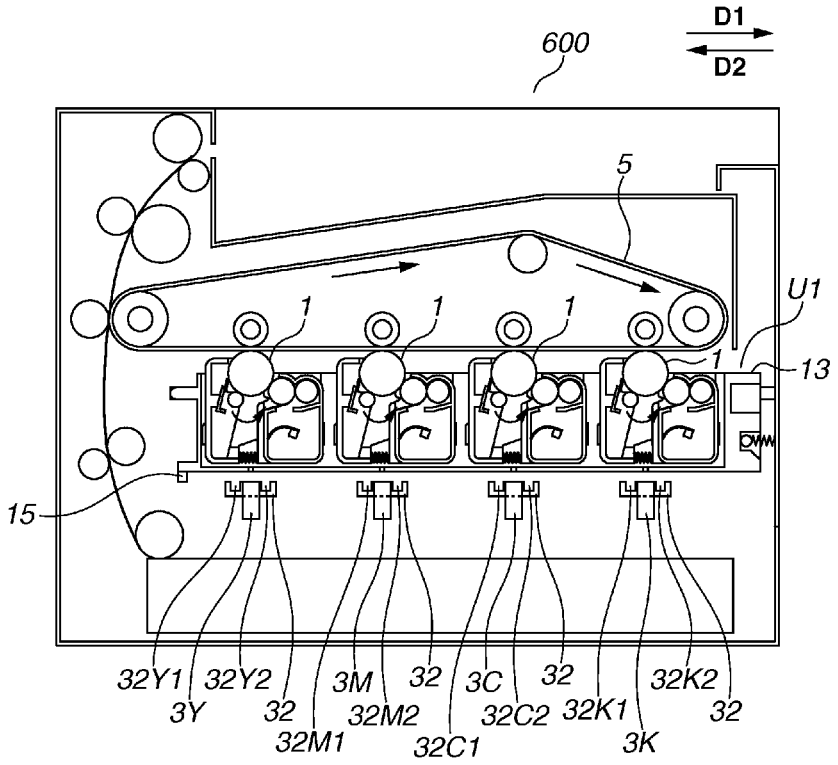
FIG. 21 is a cross-sectional view illustrating an image forming operation performed by a modification example of the image forming apparatus which includes a different exposure unit.

A modification example of the exposure unit 3 will be described with reference to FIG. 21. FIG. 21 is a schematic cross-sectional view illustrating the entire configuration of an image forming apparatus 600 according to the present modification example, which corresponds to FIG. 1. The exposure unit 3 illustrated in FIG. 1 is constituted by the optical box 30, the optical system (not illustrated), and the dust-proof member 31 (31Y, 31M, 31C, and 31K). Further, the reservoir portion 32 (32*a* and 32*b*) is provided at one end portion of the optical box 30 in the direction indicated by the arrow D1 and at the other end portion in the direction indicated by D2.

On the other hand, in the present modification example illustrated in FIG. 21, the image forming apparatus 600 has an exposure unit that is constituted by an LED unit 3 (3Y, 3M, 3C, or 3K) and the reservoir member 32. Further, the reservoir portions 32 (32Y1, 32Y2, 32M1, 32M2, 32C1, 32C2, or 32K1, 32K2) are formed on the reservoir member 32 so as to neighbor a corresponding LED unit 3 (3Y, 3M, 3C, or 3K) in the direction indicated by the arrow D1 and the direction indicated by the arrow D2.

Employing the above-mentioned configuration brings similar effects even though the exposure unit 3 is an LED unit. Further, the LED unit employed as the exposure unit 3 in the present modification example can be replaced by an electroluminescence (EL) element.

Modification Example of Moving Direction of Drawer Unit U1

Figure 22:
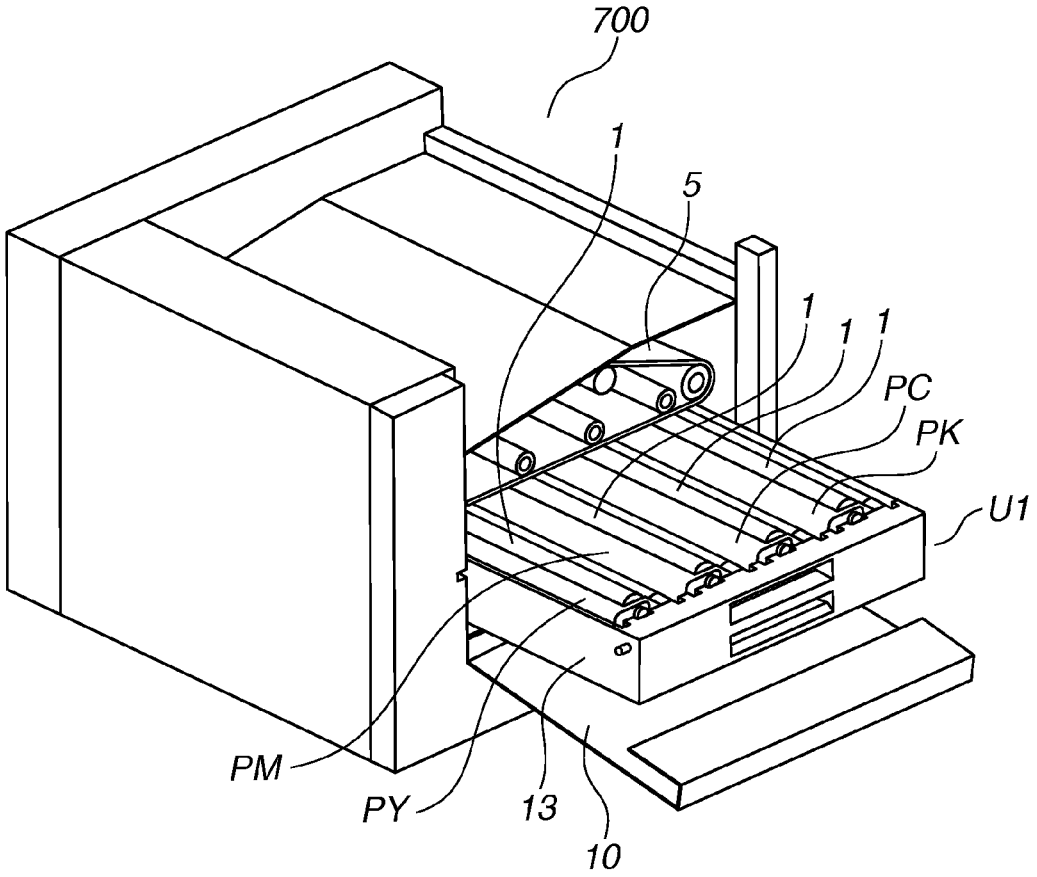
FIG. 22 is a perspective view illustrating a modification example of the drawer unit differentiated in a pull-out direction, in a state where the drawer unit is being inserted into the main body of the image forming apparatus.
Figure 23:
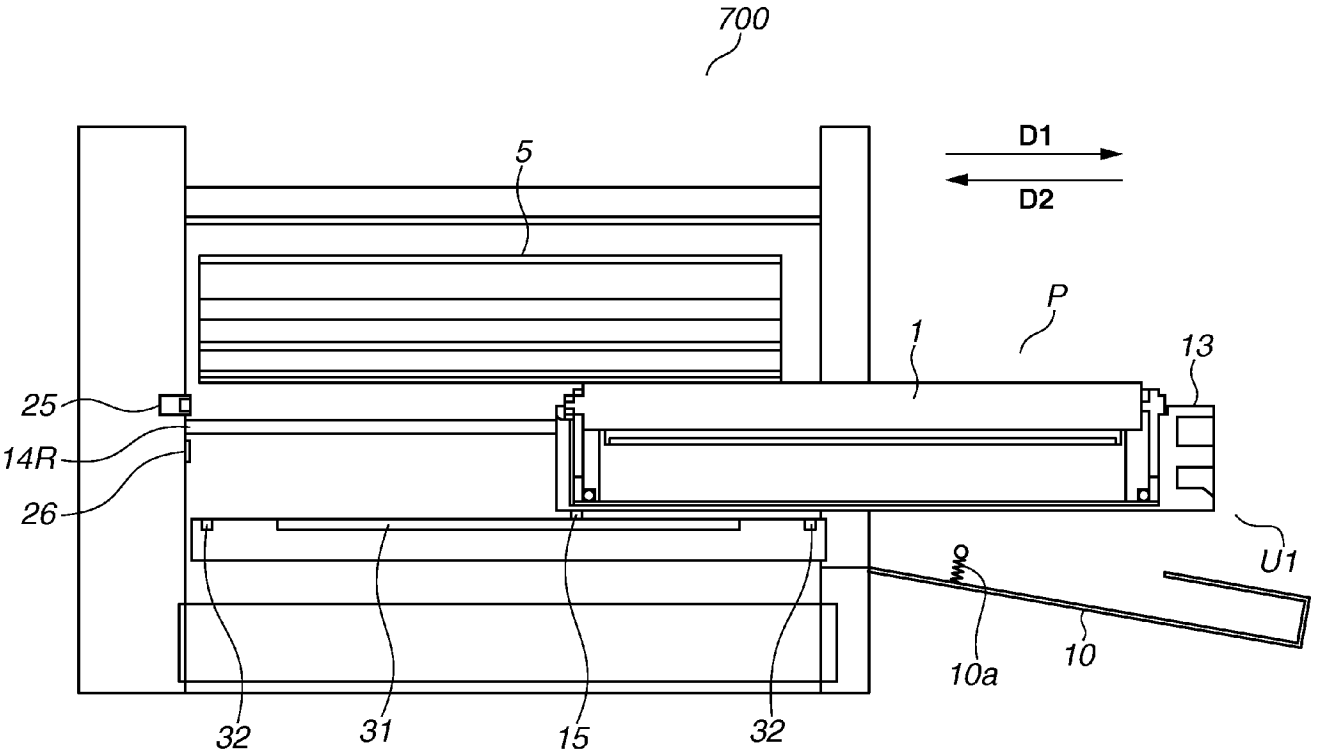
FIG. 23 is a cross-sectional view illustrating the modification example of the drawer unit differentiated in the pull-out direction, in a state where the drawer unit is being inserted into the main body of the apparatus.
Figure 24:
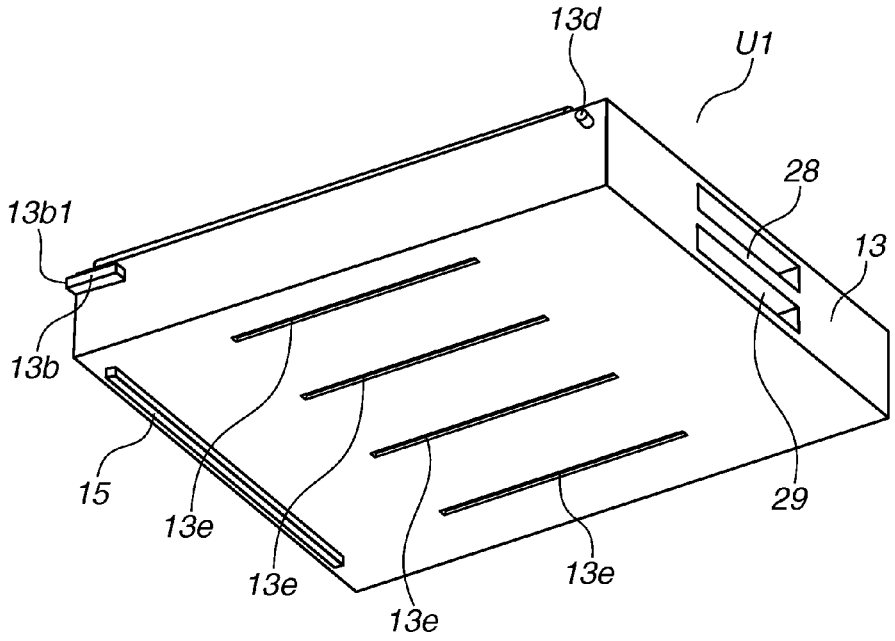
FIG. 24 illustrates the modification example of the drawer unit differentiated in the pull-out direction.
Figure 25:
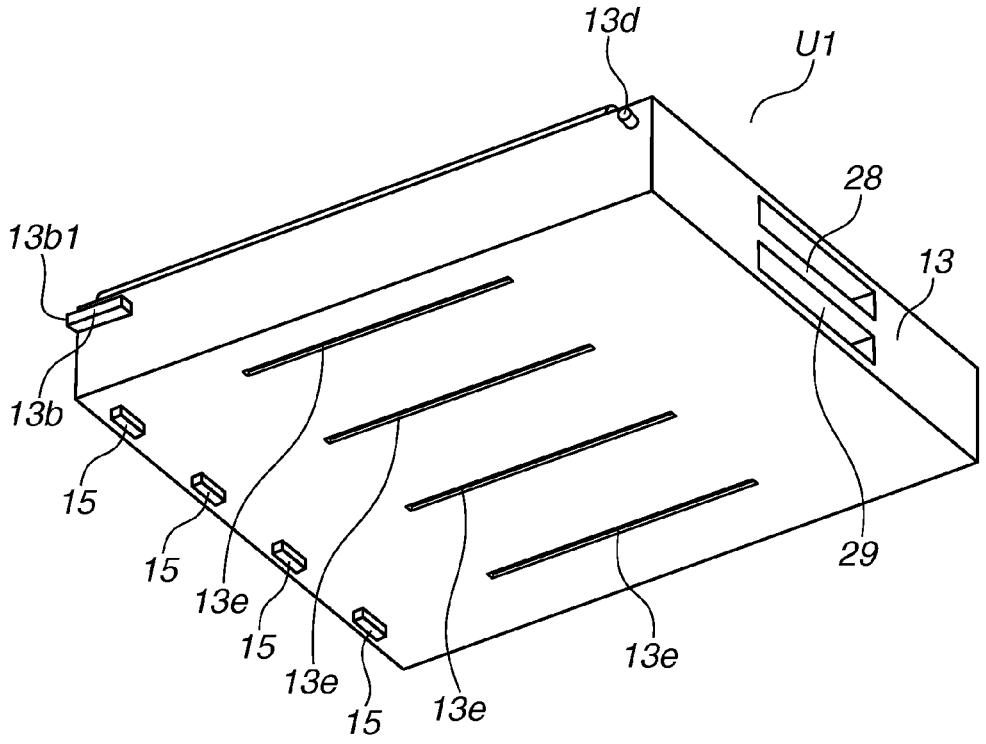
FIG. 25 illustrates another modification example of the drawer unit differentiated in the pull-out direction.

A modification example of the moving direction of the drawer unit U1 will be described with reference to FIGS. 22 through 25. FIG. 22 is a perspective view illustrating the entire configuration of an image forming apparatus 700 according to the present modification example. FIG. 23 is a schematic cross-sectional view illustrating the image forming apparatus 700 according to the present modification example in an intermediate stage of pulling out the drawer unit 13. FIGS. 24 and 25 are perspective views illustrating the drawer unit 13 of the image forming apparatus 700 according to the present modification example, which correspond to FIG. 5.

In the installed position of the cartridge P illustrated in FIGS. 1 through 6, the longitudinal direction of the cartridge P (the axial direction of the drum 1) is perpendicular to the moving direction of the drawer member 13. On the other hand, in the present modification example (see FIGS. 22 through 25), the cartridge P of the image forming apparatus 700 is disposed so that the longitudinal direction of the cartridge P (the axial direction of the drum 1) is parallel to the moving direction of the drawer member 13. Even when the above-described configuration is employed, the cleaning member 15 can clean the dust-proof member 31 and cause the removed dust to fall into the reservoir portion 32. Although the cleaning member 15 illustrated in FIG. 24 is a single type, the cleaning member 15 can be divided into a plurality of smaller cleaning members as illustrated in FIG. 25.

Figure 26:
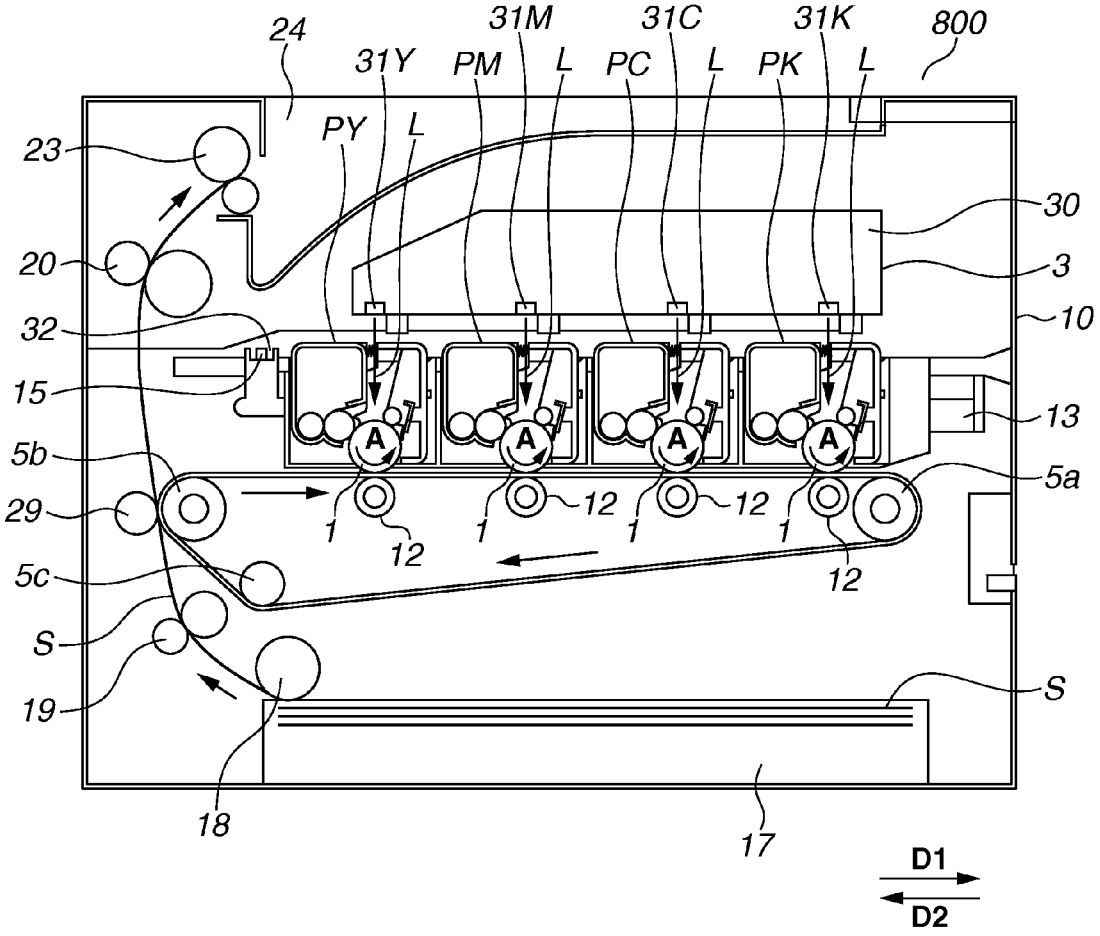
FIG. 26 is a cross-sectional view illustrating an image forming operation performed by an image forming apparatus according to a second exemplary embodiment of the present invention.
Figure 27:
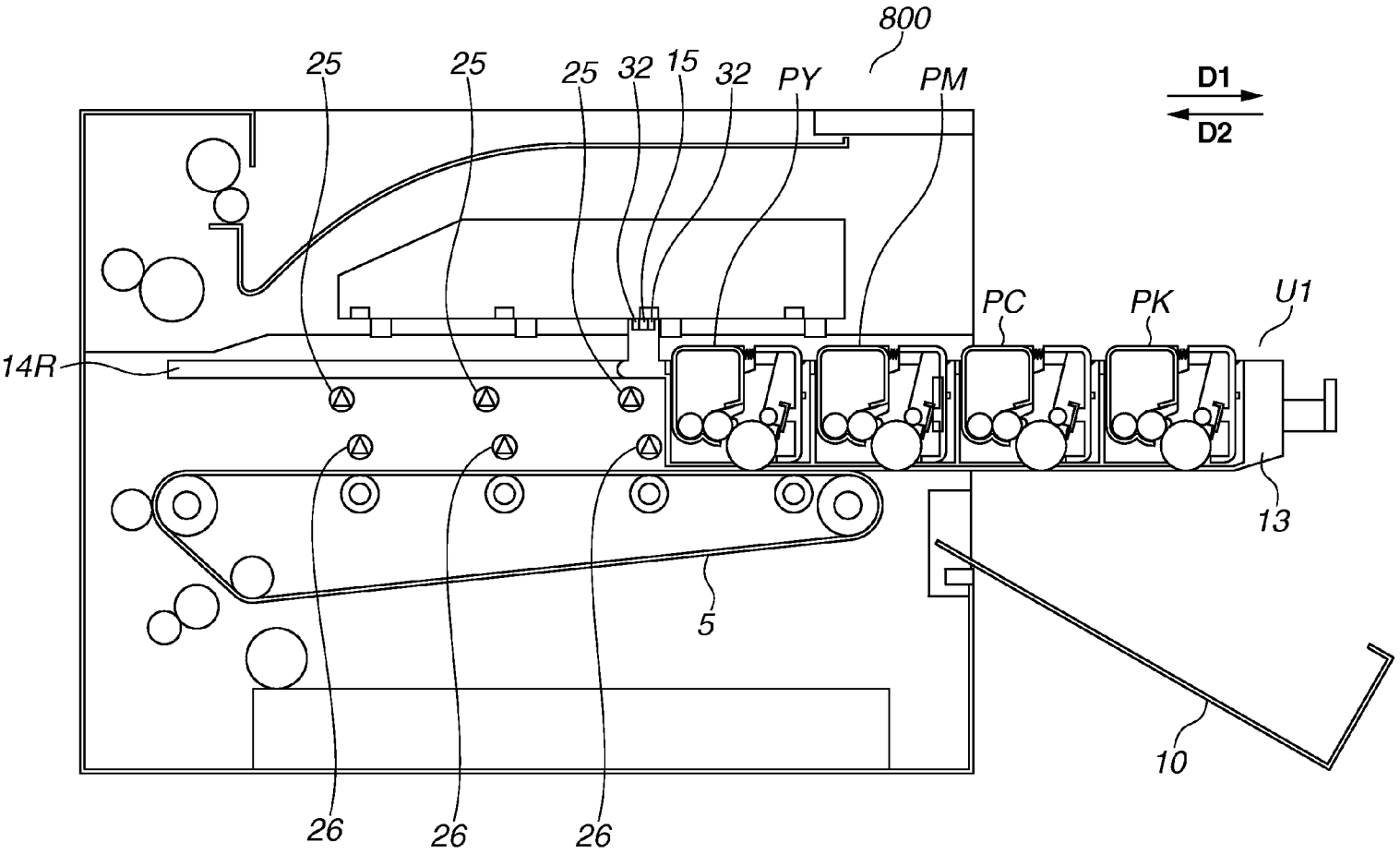
FIG. 27 is a cross-sectional view illustrating a state where a drawer unit according to the second exemplary embodiment is being inserted into the main body of the apparatus.

Next, a second exemplary embodiment of the present invention will be described with reference to FIGS. 26 and 27. FIG. 26 is a schematic cross-sectional view illustrating the entire configuration of an image forming apparatus 800 according to the present exemplary embodiment. FIG. 27 is a schematic cross-sectional view illustrating a pulled-out state of the drawer unit U1 of the image forming apparatus 800 according to the present exemplary embodiment. In the first exemplary embodiment, the transfer member 5 is positioned above the drum 1 and the exposure unit 3 is positioned below the drum 1.

On the other hand, the configuration of the image forming apparatus 800 according to the present exemplary embodiment is characterized in that the transfer member 5 is positioned below the drum 1 and the exposure apparatus 3 is positioned above the drum 1, as illustrated in FIGS. 26 and 27. Further, a cleaning member 15 is attached at the end portion of the drawer member (the movable member) 13 in the direction indicated by the arrow D2 so as to face the exposure unit 3. Two protruding portions, each of which extends toward the exposure unit 3, are formed on the drawer member 13. The protruding portions provide a clearance therebetween in which the cleaning member 15 is installed.

In the present exemplary embodiment, a reservoir portion 32 is formed at a space between the two protruding portions and the cleaning member 15. The front end of the cleaning member 15, which faces the exposure unit 3, moves according to the insertion movement of the drawer unit U1 (the movement in the direction indicated with the arrow D2), while making contact with the dust-proof member 31 (31Y, 31M, 31C, and 31K). The cleaning member 15 according to the present exemplary embodiment is configured to be movable between the cleaning position (see FIG. 27) and the non-cleaning position (see FIG. 26) with respect to the drawer unit U1, which is similar to the configurations illustrated in FIGS. 16 and 17, When the drawer unit U1 moves in the pull-out direction (the direction indicated by the arrow D1), the cleaning member 15 stays at the non-cleaning position (see FIG. 26) and the cleaning member 15 does not make contact with the dust-proof member 31.

More specifically, similarly to the first exemplary embodiment, the cleaning member 15 cleans the dust-proof member 31 (31Y, 31M, 31C, and 31K). In this case, the dust removed from the dust-proof member 31 falls into the reservoir portion 32 that moves together with the cleaning member 15. Further, the cleaning member 15 is movable between the cleaning position (see FIG. 27) and the non-cleaning position (see FIG. 26). Therefore, the number of times the cleaning member 15 makes contact with the dust-proof member 31 is reduced, thereby allowing the cleaning member 15 to be used for a long time. Alternatively, the cleaning member 15 may be configured to be placed in the cleaning position when the drawer unit U1 is pulled out and in the non-cleaning position when the drawer unit U1 is inserted.

As described above, even when the positional relationship among the drum 1, the exposure unit 3, and the transfer member 5 is different from that described in the first exemplary embodiment, it is feasible to obtain effects similar to those described in the first exemplary embodiment.

Another Modification Example

Although some exemplary embodiments and modification examples have been described, the present invention is not limited to the above-described exemplary embodiments and/or modification examples. Therefore, the present invention can be modified in various ways within the scope of the invention.

Modification Example 1

The configurations described in the first exemplary embodiment and the modification example thereof are characterized in that the reservoir portion 32 is provided to store the substance removed by the cleaning member 15 and the light transmission member 31 is provided below the drum (the image bearing member) 1 in the gravity direction. However, the present invention can encompass a modified configuration obtainable from the first exemplary embodiment and/or the modification example thereof, which is characterized by providing the light transmission member 31 below the drum (the image bearing member) 1 in the gravity direction without providing the reservoir portion 32 for storing the substance removed by the cleaning member 15.

In this case, because the light transmission member 31 is provided below the drum (the image bearing member) 1 in the gravity direction, it is feasible to prevent a substance (e.g., dust) removed by the cleaning member 15 from falling (moving) into the image forming portion (especially, the image bearing member) in the apparatus when the cleaning member cleans the exposure portion.

Modification Example 2

In the above-described exemplary embodiments and the modification examples, the cleaning member 15 is provided on the movable member 13 or the cartridge P. Alternatively, the cleaning member 15 may be provided on both of the movable member 13 and the cartridge P. More specifically, the cleaning member 15 only has to be provided on at least one of the movable member 13 and the cartridge P.

Modification Example 3

As described above, the exposure unit 3 causes exposure light to pass through the dust-proof member (the light transmission member) 31 only once as transmitted light. However, the exposure unit 3 can be configured to cause the exposure light to pass through the dust-proof member (the light transmission member) 31 twice in total, once as transmitted light and once as reflection light.

Modification Example 4

Figure 28:
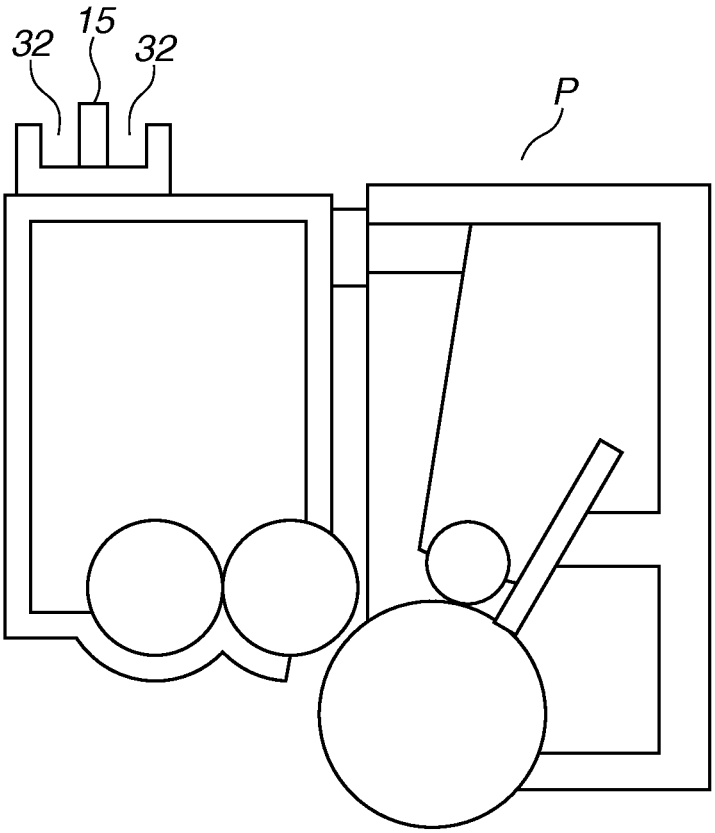
FIG. 28 illustrates a cartridge.
Figure 29:
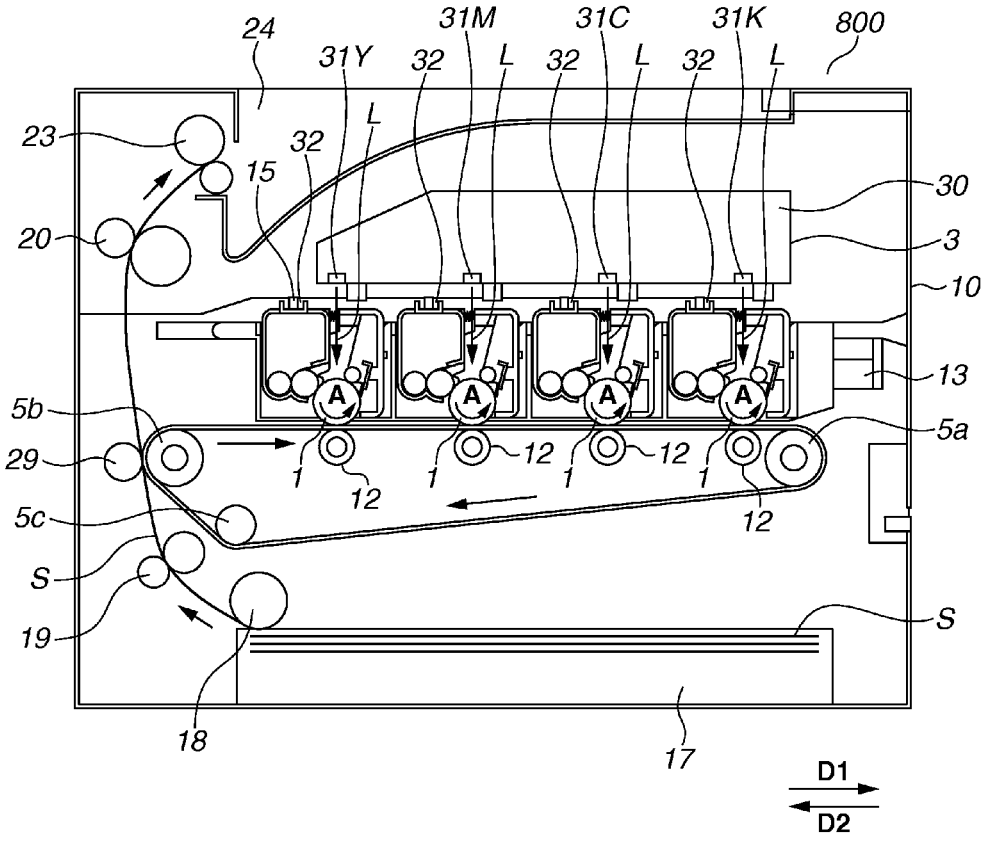
FIG. 29 illustrates a cleaning operation performed by a cleaning member.

As illustrated in FIG. 28, it is feasible to provide both the reservoir portion 32 and the cleaning member 15 in the cartridge P. According to the configuration illustrated in FIG. 28, the substance removed from the dust-proof member 31 by the cleaning member 15 is collected by the cartridge P when the drawer unit U1 is moved, as illustrated in FIG. 29. With the above-described configuration, the reservoir portion 32 becomes empty every time when the cartridge P is replaced by a new one. The cleaning member 15 can also be replaced by a new one. Therefore, the cleaning capability of the cleaning member 15 recovers every time when the cartridge P is replaced. Further, a plurality of components (i.e., the reservoir portion 32 and the cleaning members 15) is provided for each cartridge. Therefore, the load applied to each cleaning member 15 and each reservoir portion 32 can be reduced. Therefore, the cleaning member 15 can possess long-lasting capability of cleaning the exposure unit 3 (the dust-proof member 31).

The effects brought by the above-described exemplary embodiments can be summarized as follows. In short, the cleaning capability of the cleaning member can be maintained for a long time by employing the above-mentioned configurations.

Although each of the exemplary embodiments discloses a plurality of configurations to maintain the cleaning capability of the cleaning member, it is not always necessary to use all of the disclosed configurations. An effect can be obtained even when a part of the above-described configurations is used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-101224, filed May 15, 2014, and Japanese Patent Application No. 2015-048176, filed Mar. 11, 2015, which are hereby incorporated by reference herein in their entirety.

What is claimed is:

1. An image forming apparatus comprising:

an apparatus main body;

a movable member configured to move with respect to the apparatus main body in a state where the movable member supports an image bearing member on which a latent image is to be formed and a developer bearing member that bears a developer for developing the latent image, wherein the movable member is movable to an image forming position, located inside the apparatus main body, at which the image bearing member and the developer bearing member are brought into an image formable state and to an attachment/detachment position, located outside the apparatus main body, at which a cartridge including the developer bearing member is attachable/detachable to/from the movable member;

an exposure device configured to expose the image bearing member to form the latent image by irradiating the image bearing member with light having passed through a light transmission member; and a cleaning member configured to clean the light transmission member according to a movement of the movable member between the image forming position and the attachment/detachment position, wherein the cleaning member is provided on the movable member and movable with respect to the movable member, so as to be movable to a contact position at which the cleaning member makes contact with the light transmission member when the movable member moves and a noncontact position at which the cleaning member does not make contact with the light transmission member when the movable member moves.

2. The image forming apparatus according to claim 1, wherein the movable member includes a gripping member that is gripped when the movable member moves, and the cleaning member is movable between the contact position and the noncontact position when the gripping member moves with respect to the movable member.

3. The image forming apparatus according to claim 1, wherein the cleaning member is at the contact position when the movable member moves from the image forming position to the attachment/detachment position and the cleaning member is at the noncontact position when the movable member moves from the attachment/detachment position to the image forming position.

4. The image forming apparatus according to claim 1, wherein the cleaning member is at the contact position when the movable member moves from the attachment/detachment position to the image forming position and the cleaning member is at the noncontact position when the movable member moves from the image forming position to the attachment/detachment position.

5. The image forming apparatus according to claim 1, further comprising a connecting member that connects the cleaning member to the movable member and causes the cleaning member to move with respect to the movable member.

6. The image forming apparatus according to claim 1, further comprising a reservoir portion that stores a substance removed by the cleaning member.

7. The image forming apparatus according to claim 6, wherein the reservoir portion is provided in the cartridge.

8. The image forming apparatus according to claim 6, wherein the reservoir portion is provided in the apparatus main body.

9. The image forming apparatus according to claim 8, wherein the reservoir portion is provided in an optical box included in the exposure device.

10. The image forming apparatus according to claim 6, wherein the reservoir portion is provided at at least one of a starting point, an ending point, and an intermediate point of a path along which the cleaning member moves.

11. The image forming apparatus according to claim 6, wherein the reservoir portion is a recessed portion.

12. The image forming apparatus according to claim 6, wherein the reservoir portion is formed by at least one protruding portion.

13. The image forming apparatus according to claim 1, wherein the cartridge includes the image bearing member.

14. The image forming apparatus according to claim 1, wherein the light transmission member is provided below the image bearing member in a gravity direction.

15. The image forming apparatus according to claim 1, wherein the light transmission member is provided above the image bearing member in a gravity direction.

16. The image forming apparatus according to claim 1, wherein the exposure device includes a light emitting diode (LED) as a light source.

17. The image forming apparatus according to claim 1, wherein the movable member is movable in a direction perpendicular to an axis of the image bearing member.

18. The image forming apparatus according to claim 1, wherein the movable member is movable in a direction horizontal to an axis of the image bearing member.

19. An image forming apparatus comprising:

an apparatus main body;

a movable member configured to move with respect to the apparatus main body in a state where the movable member supports an image bearing member on which a latent image is to be formed and a developer bearing member that bears a developer for developing the latent image, wherein the movable member is movable to an image forming position, located inside the apparatus main body, at which the image bearing member and the developer bearing member are brought into an image formable state and an attachment/detachment position, located outside the apparatus main body, at which a cartridge including the developer bearing member is attachable/detachable to/from the movable member;

an exposure device configured to expose the image bearing member to form the latent image by irradiating the image bearing member with light having passed through a light transmission member; and a cleaning member configured to clean the light transmission member according to a movement of the movable member, wherein the cartridge includes a reservoir portion that stores a substance removed by the cleaning member.

20. An image forming apparatus comprising:

an apparatus main body;

a movable member configured to move with respect to the apparatus main body in a state where the movable member supports an image bearing member on which a latent image is to be formed and a developer bearing member that bears a developer for developing the latent image, wherein the movable member is movable to an image forming position, located inside the apparatus main body, at which the image bearing member and the developer bearing member are brought into an image formable state and to an attachment/detachment position, located outside the apparatus main body, at which a cartridge including the developer bearing member is attachable/detachable to/from the movable member;

an exposure device configured to expose the image bearing member to form the latent image by irradiating the image bearing member with light having passed through a light transmission member; and a cleaning member configured to clean the light transmission member according to a movement of the movable member between the image forming position and the attachment/detachment position, wherein the apparatus main body includes a reservoir portion that stores a substance removed by the cleaning member.

* * * * *